US012448715B2

(12) United States Patent
Han et al.

(10) Patent No.: US 12,448,715 B2
(45) Date of Patent: Oct. 21, 2025

(54) WASHING MACHINE AND CONTROLLING METHOD FOR THE SAME

(71) Applicant: SAMSUNG ELECTRONICS CO., LTD., Suwon-si (KR)

(72) Inventors: Wonjae Han, Suwon-si (KR); Jeonggi Hong, Suwon-si (KR); Sungjong Kim, Suwon-si (KR); Hooijoong Kim, Suwon-si (KR); Sukwoo Park, Suwon-si (KR); Jaepoong Lee, Suwon-si (KR); Sooyeon Jin, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 416 days.

(21) Appl. No.: 17/955,762

(22) Filed: Sep. 29, 2022

(65) Prior Publication Data

US 2023/0175187 A1 Jun. 8, 2023

Related U.S. Application Data

(63) Continuation of application No. PCT/KR2022/013479, filed on Sep. 7, 2022.

(51) Int. Cl.
*D06F 34/08* (2020.01)
*D06F 33/42* (2020.01)
(Continued)

(52) U.S. Cl.
CPC ..... *D06F 34/08* (2020.02); *D06F 33/42* (2020.02); *D06F 33/47* (2020.02); *D06F 33/48* (2020.02);
(Continued)

(58) Field of Classification Search
CPC ..... D06F 33/42; D06F 33/47; D06F 33/48; D06F 34/08; D06F 34/34; D06F 37/30;
(Continued)

(56) References Cited

U.S. PATENT DOCUMENTS 11,885,057 B2 1/2024 Park et al.
2014/0101864 A1* 4/2014 Lee ..... D06F 37/225 8/137
(Continued)

FOREIGN PATENT DOCUMENTS

JP 9-108493 4/1997
JP 2019-72377 A 5/2019
(Continued)

OTHER PUBLICATIONS

Supplementary European Search Report dated Sep. 30, 2024 issued in European Application No. EP 22 90 4405.
(Continued)

*Primary Examiner* — Joseph L. Perrin
(74) *Attorney, Agent, or Firm* — STAAS & HALSEY LLP

(57) ABSTRACT

A washing machine for controlling optimal operating revolutions per minute (rpm) of a drain pump in a draining course and a dehydrating course includes a washing tub; a drain pump configured to drain water in the washing tub; a pump motor configured to operate the drain pump; an inverter circuit configured to supply a driving current to the pump motor to operate the drain pump; and a controller configured to control the inverter circuit to supply reference power to the pump motor in response to starting a draining course, determine reference revolutions per minute (rpm) based on average rpm of the pump motor during a preset
(Continued)

period of time, and control the inverter circuit to operate the pump motor at the reference rpm in response to the determining of the reference rpm.

20 Claims, 18 Drawing Sheets

(51) Int. Cl.

| | |
|---|---|
| ***D06F 33/47*** | (2020.01) |
| ***D06F 33/48*** | (2020.01) |
| ***D06F 34/34*** | (2020.01) |
| ***D06F 37/30*** | (2020.01) |
| ***D06F 39/08*** | (2006.01) |
| *D06F 103/18* | (2020.01) |
| *D06F 103/42* | (2020.01) |
| *D06F 103/48* | (2020.01) |
| *D06F 105/08* | (2020.01) |
| *D06F 105/58* | (2020.01) |

(52) U.S. Cl.
CPC ..... *D06F 34/34* (2020.02); *D06F 37/30* (2013.01); *D06F 39/08* (2013.01); *D06F 39/082* (2013.01); *D06F 39/085* (2013.01); *D06F 2103/18* (2020.02); *D06F 2103/42* (2020.02); *D06F 2103/48* (2020.02); *D06F 2105/08* (2020.02); *D06F 2105/58* (2020.02)

(58) Field of Classification Search
CPC .... D06F 39/08; D06F 39/082; D06F 2103/18; D06F 2103/42; D06F 2103/48; D06F 2105/08; D06F 2105/58
See application file for complete search history.

(56) References Cited

U.S. PATENT DOCUMENTS

| | | | | |
|---|---|---|---|---|
| 2015/0265132 | A1* | 9/2015 | Sohn | A47L 15/0049 134/57 DL |
| 2019/0127900 | A1 | 5/2019 | Lee et al. | |
| 2021/0156065 | A1* | 5/2021 | Je | D06F 37/40 |
| 2021/0164143 | A1 | 6/2021 | Kang | |
| 2021/0277563 | A1 | 9/2021 | Kim et al. | |
| 2021/0285140 | A1* | 9/2021 | Rew | D06F 34/10 |
| 2021/0285141 | A1* | 9/2021 | Park | D06F 23/04 |
| 2021/0317834 | A1* | 10/2021 | Lee | F04D 29/2238 |

FOREIGN PATENT DOCUMENTS

| | | | |
|---|---|---|---|
| JP | 7207649 | | 1/2023 |
| KR | 10-0249689 | B1 | 3/2000 |
| KR | 10-0656168 | B1 | 12/2006 |
| KR | 10-2011-0112486 | | 10/2011 |
| KR | 10-1756409 | B1 | 7/2017 |
| KR | 10-2019-0115562 | | 1/2019 |
| KR | 10-2020-0005381 | | 1/2020 |
| KR | 10-2069766 | | 1/2020 |
| KR | 10-2069766 | B1 | 1/2020 |
| KR | 10-2020-0028095 | | 3/2020 |
| KR | 10-2522303 | | 4/2023 |
| KR | 10-2561542 | | 7/2023 |

OTHER PUBLICATIONS

International Search Report dated Dec. 30, 2022 issued in PCT Application No. PCT/KR2022/013479.
Written Opinion dated Dec. 30, 2022 issued in PCT Application No. PCT/KR2022/013479.

* cited by examiner

WASHING MACHINE AND CONTROLLING METHOD FOR THE SAME

CROSS-REFERENCE TO RELATED APPLICATION(S)

This application a continuation application, under 35 U.S.C. § 111(a), of International Application No. PCT/KR2022/013479, filed Sep. 7, 2022, which is based on claims priority under 35 U.S.C. § 119 to Korean Patent Application No. 10-2021-0174573, filed on Dec. 8, 2021 in the Korean Intellectual Property Office, the disclosure of which is incorporated by reference herein in its entirety.

BACKGROUND

1. Field

The disclosure relates to a washing machine and method for controlling the same, and more particularly, to a washing machine and method for controlling the same capable of increasing drain efficiency and minimizing noise and vibration caused by a drain pump during a draining course.

2. Description of Related Art

In general, the washing machine may include a tub for storing water for laundry and a drum rotationally installed in the tub. The washing machine may do laundry by rotating the drum that contains clothes.

The washing machine may perform a washing process for washing the clothes, a rinsing process for rinsing the washed clothes, and a dehydrating process for dehydrating the clothes. The washing machine supplies water into the tub in the washing process and the rinsing process to perform washing and rinsing of the clothes, and performs a draining course to drain the water used for washing and rinsing.

The draining course may refer to a course in which a drain pump in the washing machine operates to drain the water in the tub outside through a drain tube.

The traditional washing machine controls operating revolutions per minute (rpm) of the drain pump without considering environmental conditions of the washing machine, so drain efficiency may be lowered and vibration and noise may occur. In addition, the operating rpm of the drain pump is controlled without considering vibration of the tub in the dehydrating course after completion of the draining course, so the drain efficiency may be reduced.

SUMMARY

According to an aspect of the disclosure, a washing machine includes a washing tub; a drain pump configured to drain water in the washing tub; a pump motor configured to operate the drain pump; an inverter circuit configured to supply a driving current to the pump motor to operate the drain pump; and a controller configured to control the inverter circuit to supply reference power to the pump motor in response to starting of a draining course, determine reference revolutions per minute (rpm) based on average rpm of the pump motor during a preset period of time, and control the inverter circuit to operate the pump motor at the reference rpm in response to the determining of the reference rpm.

The controller may determine the reference rpm based on the average rpm of the pump motor during the preset period of time when a reference time passes after the draining course is started.

The washing machine may further include a display, and the draining course includes a first draining course and a second draining course which starts after the first draining course, and the controller may further control the display to output a visual indication to indicate that the drain pump has a problem based on a difference between first reference rpm determined in the first draining course and second reference rpm determined in the second draining course being equal to or greater than a preset value.

The washing machine may further include a water level sensor for detecting a water level of the water in the washing tub, and the controller may further configured to control the inverter circuit to operate the pump motor at the reference rpm from a time at which the reference rpm is determined to a time at which a reference time passes after the water level in the washing tub reaches a preset water level.

The preset water level may be a reset water level.

The washing machine may further include a driving motor configured to rotate the drum, and the controller may control target rpm of the pump motor based on the reference rpm and an operating rpm of the driving motor at a start of a dehydrating course after the draining course is completed The controller may further configured to control the inverter circuit to stop driving the pump motor based on determining of the operating rpm of the driving motor being lower than first preset rpm.

The controller may further configured to control the inverter circuit to operate the pump motor at the reference rpm based on determining of the operating rpm of the driving motor being higher than the first preset rpm and lower than second preset rpm.

The controller may further configured to control the inverter circuit to operate the pump motor at first rpm higher than the reference rpm based on determining of the operating rpm of the driving motor being higher than the second preset rpm and lower than third preset rpm.

The controller may further configured to control the inverter circuit to operate the pump motor at second rpm higher than the first rpm based on determining of the operating rpm of the driving motor being higher than the third preset rpm.

According to an aspect of the disclosure, a method of controlling a washing machine includes controlling an inverter circuit to supply reference power to a pump motor which operates a drain pump in response to starting a draining course; determining reference revolutions per minute (rpm) based on average rpm of the pump motor during a preset period of time; and controlling the inverter circuit to operate the pump motor at the reference rpm in response to the determining of the reference rpm.

The determining of the reference rpm may include determining the reference rpm based on the average rpm of the pump motor during the preset period of time when a reference time passes after the draining course is started.

The draining course may include a first draining course and a second draining course which starts after the first draining course. The method of controlling the washing machine may further include providing feedback indicating that the drain pump has a problem based on a difference between first reference rpm determined in the first draining course and second reference rpm determined in the second draining course starting after the first draining course being equal to or greater than a preset value.

The method of controlling the washing machine may further include detecting a water level of the water in a washing tub, and the controlling of the inverter circuit to operate the pump motor at the reference rpm may further include controlling the inverter circuit to operate the pump motor at the reference rpm from a time at which the reference rpm is determined to a time at which a reference time passes after a water level in the washing tub reaches a preset water level.

The preset water level may be a reset water level.

The method of controlling the washing machine may further include controlling target rpm of the pump motor based on the reference rpm and operating rpm of a driving motor which rotates a drum at a start of a dehydrating course after the draining course is completed.

The controlling of the target rpm of the pump motor may include controlling the inverter circuit to stop driving the pump motor based on determining of the operating rpm of the driving motor being lower than first preset rpm.

The controlling of the target rpm of the pump motor may include controlling the inverter circuit to operate the pump motor at the reference rpm based on determining of the operating rpm of the driving motor being higher than the first preset rpm and lower than second preset rpm.

The controlling of the target rpm of the pump motor may include controlling the inverter circuit to operate the pump motor at first rpm higher than the reference rpm based on determining of the operating rpm of the driving motor being higher than the second preset rpm and lower than third preset rpm.

The controlling of the target rpm of the pump motor may include controlling the inverter circuit to operate the pump motor at second rpm higher than the first rpm based on determining of the operating rpm of the driving motor being higher than the third preset rpm.

DETAILED DESCRIPTION

Figure 1:
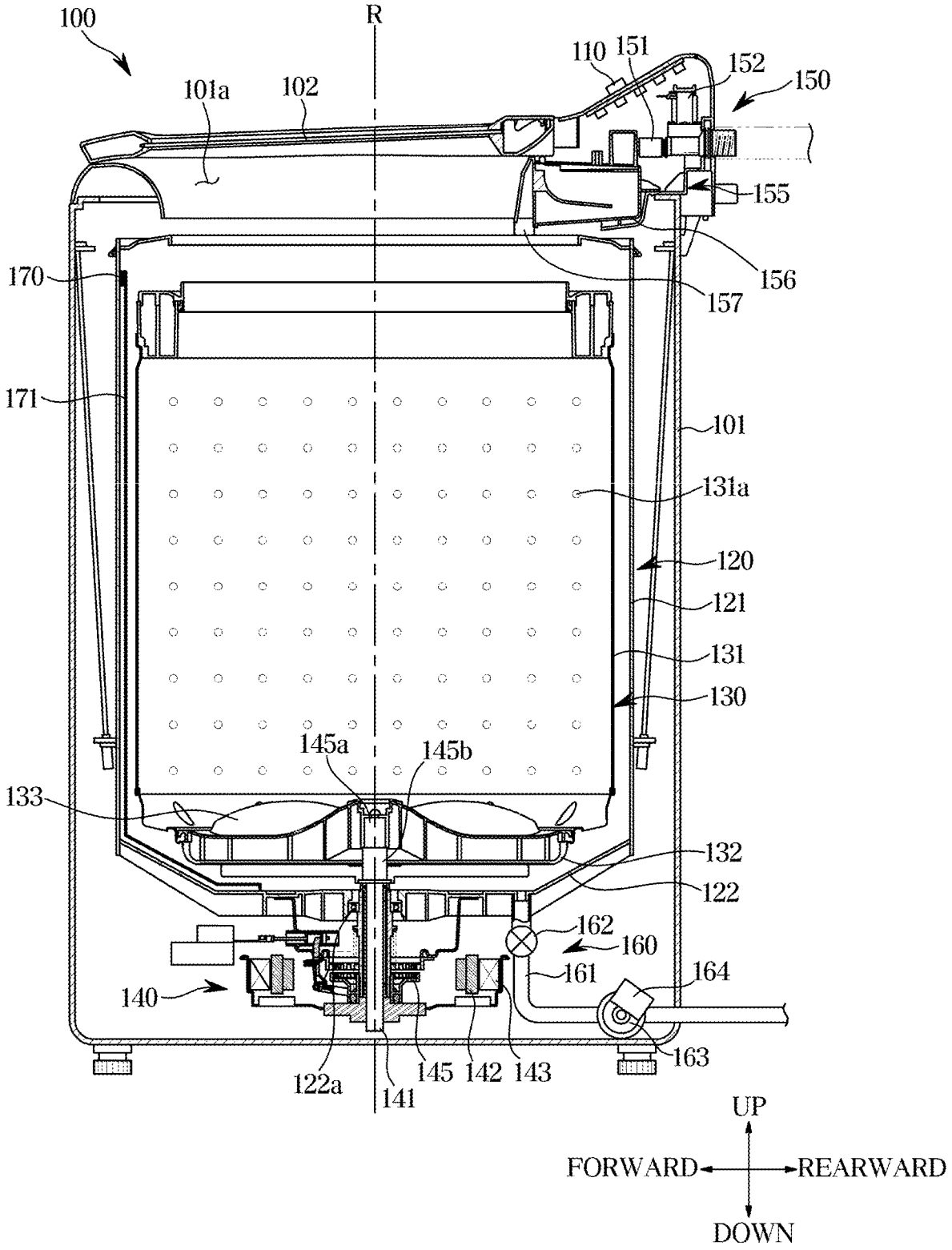
FIG. 1 illustrates an example of a washing machine, according to an embodiment.

Embodiments and features as described and illustrated in the disclosure are merely examples, and there may be various modifications replacing the embodiments and drawings at the time of filing this application.

The terminology used herein is for the purpose of describing particular embodiments only and is not intended to limit the present disclosure.

For example, the singular forms "a", "an" and "the" as herein used are intended to include the plural forms as well, unless the context clearly indicates otherwise.

The terms "comprises" and/or "comprising," when used in this specification, represent the presence of stated features, integers, steps, operations, elements, components or combinations thereof, but do not preclude the presence or addition of one or more other features, integers, steps, operations, elements, components, or combinations thereof.

The term including an ordinal number such as "first", "second", or the like is used to distinguish one component from another and does not restrict the former component.

Furthermore, the terms, such as "~ part", "~ block", "~ member", "~ module", etc., may refer to a unit of handling at least one function or operation. For example, the terms may refer to at least one process handled by hardware such as a field-programmable gate array (FPGA)/application specific integrated circuit (ASIC), etc., software stored in a memory, or at least one processor.

The disclosure provides a washing machine and method for controlling the same for optimally controlling an operating revolutions per minute (rpm) of a drain pump in a draining course and/or a dehydrating course.

According to the disclosure, optimal operating revolutions per minute (rpm) of a drain pump may be determined only by updating simple software without a need for additional hardware.

According to the disclosure, optimal operating rpm of a drain pump may be determined without a requirement for a complex algorithm.

According to the disclosure, vibration and noise that may occur in a draining course and/or a dehydrating course may be reduced.

According to the disclosure, drainage may be efficiently performed in a draining course and/or a dehydrating course.

An embodiment of the disclosure will now be described in detail with reference to accompanying drawings. Throughout the drawings, like reference numerals or symbols refer to like parts or components.

The principle and embodiments of the disclosure will now be described with reference to accompanying drawings.

Figure 2:
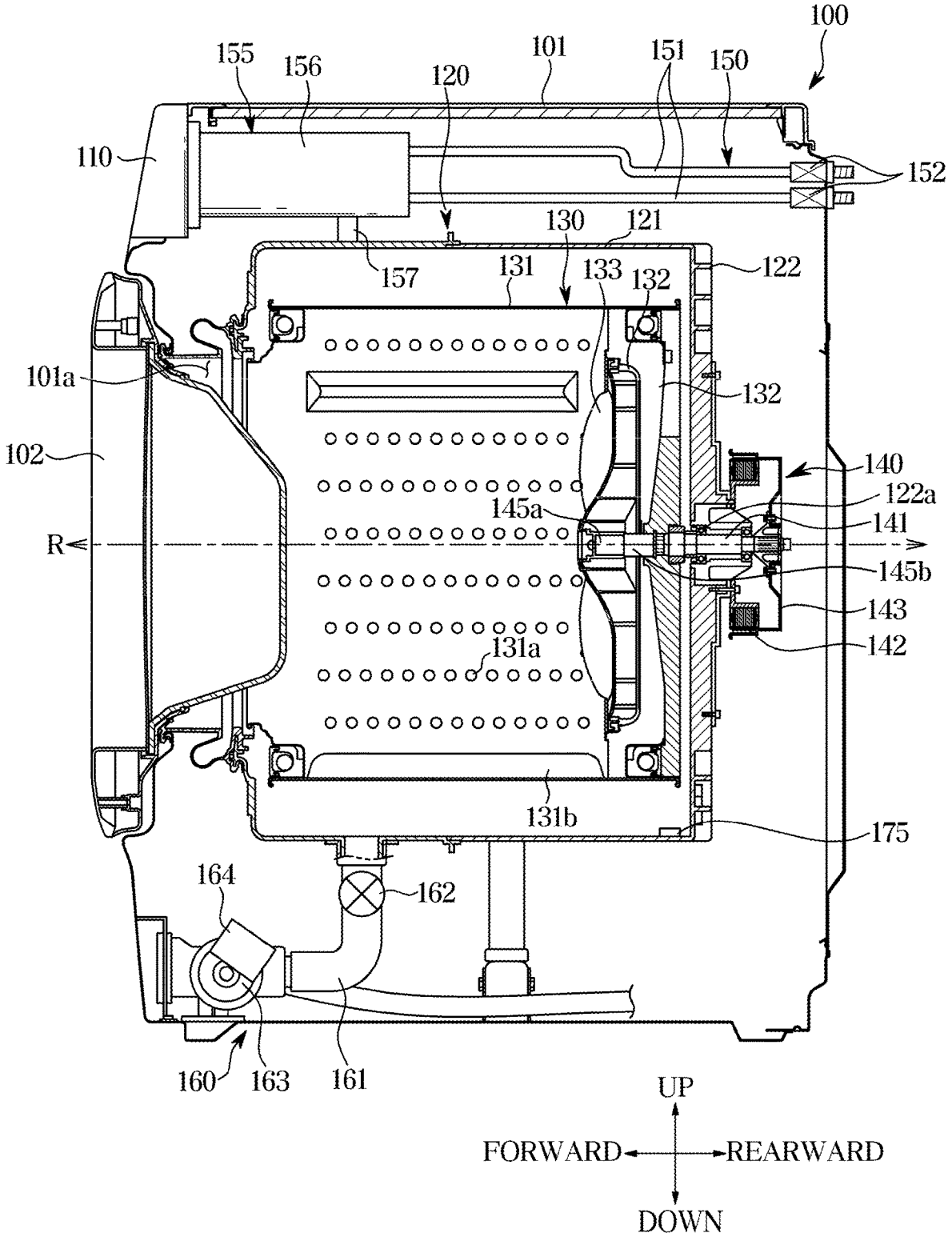
FIG. 2 illustrates another embodiment of a washing machine, according to an embodiment.
Figure 3:
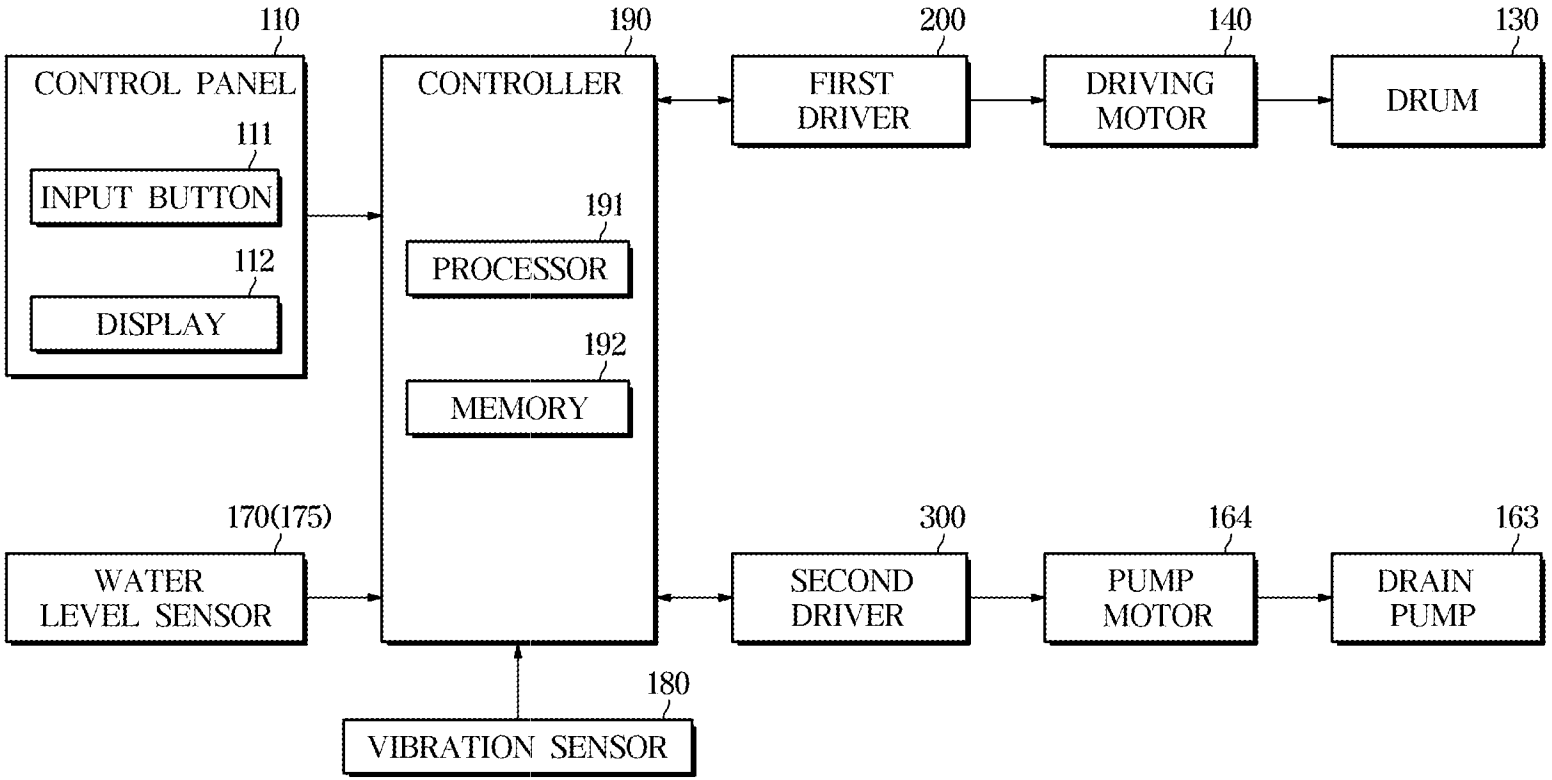
FIG. 3 is a block diagram illustrating a configuration of a washing machine, according to an embodiment.

FIG. 1 illustrates an example of a washing machine, according to an embodiment. FIG. 2 illustrates another embodiment of a washing machine, according to an embodiment. FIG. 3 is a block diagram illustrating a configuration of a washing machine, according to an embodiment.

Referring to FIGS. 1, 2 and 3, a washing machine 100 may include a control panel 110, a washing tub 120, a drum 130, a driving motor 140, a water supplier 150, a detergent supplier 155, a drain 160, drivers 200 and 300, a water level sensor (170 or 175), a vibration sensor 180 and a controller 190.

The washing machine 100 may include a cabinet 101 to accommodate the components included in the washing machine 100. The cabinet 101 may accommodate the control panel 110, the water level sensor 170 or 175, the drivers 200 and 300, the driving motor 140, the water supplier 150, the drain 160, the detergent supplier 155, the washing tub 120 and the drum 130.

An opening 101*a* is formed on one side of the cabinet 101 for drawing in or out the laundry.

For example, the washing machine 100 may include a top-loading washing machine with the inlet 101*a*, through which to draw in or out the laundry, formed on the top side of the cabinet 101 as shown in FIG. 1, or a front-loading washing machine with the inlet 101*a*, through which to draw in or out the laundry, formed on the front side of the cabinet 101 as shown in FIG. 2. In the embodiment, the washing machine 100 is not limited to the top-loading washing machine or the front-loading washing machine, but may correspond to any of the top-loading washing machine and the front-loading washing machine. Of course, the washing machine 100 may include any loading type of washing machine other than the top-loading washing machine and the front-loading washing machine.

A door 102 is arranged on one side of the cabinet 101 to open or close the inlet 101*a*. The door 101 may be arranged on the same surface as the inlet 101*a* and installed on the cabinet 101 to pivot on a hinge.

The control panel 110 may be arranged on one surface of the cabinet 101 to provide a user interface for interacting with the user.

The control panel 110 may include, for example, an input button 111 for obtaining a user input, and a display 112 for displaying a laundry setting or laundry operation information in response to the user input.

The input button 111 may include, for example, a power button, an operation button, a course selection dial (or course selection buttons) and washing/rinsing/dehydrating setting buttons. The input button may include, for example, a tact switch, a push switch, a slide switch, a toggle switch, a micro switch, or a touch switch.

The input button 111 may provide an electric output signal corresponding to the user input to the controller 190.

The display 112 may include a screen for displaying a laundry course selected by turning the course selection dial (or by pressing the course selection button) and an operation time of the washing machine 100, and an indicator for indicating a washing setting/rinsing setting/dehydration setting selected by the setting button. The display 112 may include, for example, a liquid crystal display (LCD) panel 112, a light emitting diode (LED) panel, or the like.

The display 112 may receive information to be displayed from the controller 190 and display information corresponding to the received information.

The washing tub 120 and the drum 130 may be arranged in the cabinet 101.

The washing tub 120 receives water for washing and rinsing, and the drum 130 is rotationally equipped in the tub 120 to accommodate clothes.

The tub 120 may have the shape of e.g., a cylinder with a bottom surface open. The tub 120 may include a tub bottom surface 122 shaped almost like a circle and a tub side wall 121 provided along the circumference of the tub bottom surface 122. Another bottom surface of the tub 120 may be opened to draw in or draw out clothes or may have an opening formed thereon.

In the case of the top-loading washing machine, as shown in FIG. 1, the tub 120 may be arranged with the tub bottom surface 122 facing the bottom of the washing machine 100 and a center axis R of the tub side wall 121 being substantially perpendicular to the floor. In the case of the front-loading washing machine, as shown in FIG. 2, the tub 120 may be arranged with the tub bottom surface 122 facing the back of the washing machine 100 and the center axis R of the tub side wall 121 being substantially parallel to the floor.

A bearing 122*a* may be arranged on the tub bottom surface 122 to rotationally fix the driving motor 140.

The drum 130 may be rotationally arranged in the tub 120. The drum 130 may accommodate clothes, i.e., loads.

The drum 130 may have the shape of e.g., a cylinder with a bottom surface open. The drum 130 may include a drum bottom surface 132 shaped almost like a circle and a drum side wall 131 provided along the circumference of the drum bottom surface 132. Another bottom surface of the drum 130 may be opened to draw clothes into or out of the drum 130 or may have an opening formed thereon.

In the case of the top-loading washing machine, as shown in FIG. 1, the drum 130 may be arranged with the drum bottom surface 132 facing the bottom of the washing machine 100 and the center axis R of the drum side wall 131 being substantially perpendicular to the floor. In the case of the front-loading washing machine, as shown in FIG. 2, the drum 130 may be arranged with the drum bottom surface 132 facing the back of the washing machine 100 and the center axis R of the drum side wall 131 being substantially parallel to the floor.

On the drum side wall 131, through holes 131*a* may be formed to connect the inside and outside of the drum 130 for water supplied to the tub 120 to flow into the drum 130.

In the case of the top-loading washing machine as shown in FIG. 1, a pulsator 133 may be rotationally provided on the inner side of the drum bottom surface 132. The pulsator 133 may be rotated separately from the drum 130. In other words, the pulsator 133 may be rotated in the same direction as or different direction from the drum 130. The pulsator 133 may be rotated at the same rotation speed as or a different rotation speed from the drum 130.

In the case of the front-loading washing machine as shown in FIG. 2, a lifter 131*b* is provided on the drum side wall 131 to lift clothes up the drum 130 while the drum 130 is being rotated. Furthermore, in various embodiments, even for the front-loading washing machine, the pulsator 133 may be rotationally arranged on the inner side of the drum bottom surface 132. The pulsator 133 may be rotated separately from the drum 130. In other words, the pulsator 133 may be rotated in the same direction as or different direction from the drum 130. The pulsator 133 may be rotated at the same rotation speed as or a different rotation speed from the drum 130.

The drum bottom surface 132 may be connected to a rotation shaft 141 of the driving motor 140 that rotates the drum 130.

The driving motor 140 may rotate the drum 130 included in the washing tub 120 based on a driving current applied from the first driver 200.

In an embodiment, the driving motor 140 may produce torque to rotate the drum 130.

The driving motor 140 may be arranged on the outer side of the tub bottom surface 122 of the tub 120, and connected to the drum bottom surface 132 of the drum 130 through the rotation shaft 141. The rotation shaft 141 may penetrate the tub bottom surface 122, and may be rotationally supported by the bearing 122*a* arranged on the tub bottom surface 122.

The driving motor 140 may include a stator 142 fixed onto the outer side of the tub bottom surface 122, and a rotor 143 arranged to be rotatable against the tub 120 and the stator 142. The rotor 143 may be connected to the rotation shaft 141.

The rotor 143 may be rotated by magnetic interaction with the stator 142, and the rotation of the rotor 143 may be delivered to the drum 130 through the rotation shaft 141.

The driving motor 140 may include e.g., a brush-less direct current (BLDC) motor or a permanent synchronous motor (PMSM) capable of easily controlling the rotation speed.

In the case of the top-loading washing machine as shown in FIG. 1, there may be a clutch 145 for delivering the torque of the driving motor 140 to both the pulsator 133 and the drum 130 or the pulsator 133. The clutch 145 may be connected to the rotation shaft 141. The clutch 145 may distribute the rotation of the rotation shaft 141 to an inner shaft 145*a* and an outer shaft 145*b*. The inner shaft 145*a* may be connected to the pulsator 133. The outer shaft 145*a* may be connected to the drum bottom surface 132. The clutch 145 may deliver the rotation of the rotation shaft 141 to both the pulsator 133 and the drum 130 through the inner shaft 145*a* and the outer shaft 145*b*, or deliver the rotation of the rotation shaft 141 only to the pulsator 133 through the inner shaft 145*a*.

In the case of the front-loading washing machine as shown in FIG. 2, the driving motor 140 may rotate both the pulsator 133 and the drum 130, or the pulsator 133 or the drum 130.

In various embodiments, the driving motor 140 may be a dual-rotor motor equipped with an outer rotor and an inner rotor on the outer side and the inner side in a radial direction of one stator.

The inner rotor and the outer rotor of the driving motor 140 may be connected to the pulsator 133 and the drum 130 through the inner shaft 145*a* and the outer shaft 145*b*, respectively, and may drive the pulsator 133 and the drum 130 directly.

However, a method of driving the drum 130 and the pulsator 133 is not limited according to the type of the washing machine 100 (front-loading washing machine or top-loading washing machine), and even for the top-loading washing machine, the dual-rotor motor may be used for the driving motor 140 to rotate the pulsator 133 and the drum 130 separately, and even for the front-loading washing machine, the one stator 142, the one rotor 143, and the clutch 145 may be used to rotate the pulsator 133 and the drum 130 separately.

The water supplier 150 may supply water to the tub 120 and the drum 130. The water supplier 150 includes a water supply conduit 151 connected to an external water source to supply water to the tub 120, and a water supply valve 152 arranged in the water supply conduit 151. The water supply conduit 151 may be arranged above the tub 120 and may extend to a detergent container 156 from the external water source. The water is guided to the tub 120 via the detergent container 156. The water supply valve 152 may allow or block the supply of water to the tub 120 from the external water source in response to an electric signal. The water supply valve 152 may include, for example, a solenoid valve that is opened or closed in response to an electric signal.

The detergent supplier 155 may supply a detergent to the tub 120 and the drum 130. The detergent supplier 155 is arranged above the tub 120 and includes the detergent container 156 and a mixing conduit 157 that connects the detergent container 156 to the tub 120. The detergent container 156 may be connected to the water supply conduit 151, and the water supplied through the water supply conduit 151 may be mixed with the detergent in the detergent container 156. The mixture of the detergent and the water may be supplied to the tub 120 through the mixing conduit 157.

The drain 160 may drain out the water stored in the tub 120 or the drum 130. The drain 160 may include a drain conduit 161 arranged below the tub 120 and extending to the outside of the cabinet 101 from the tub 120. The drain 160 may further include a drain valve 162 arranged in the drain conduit 161. The drain 160 may further include a drain pump 163 arranged in the drain conduit 161 and a pump motor 164 for operating the drain pump 163. The pump motor 164 may generate rotational force to create a difference in pressure between both sides of the drain pump 163, and the difference in pressure may make the water stored in the tub 120 discharged outside through the drain conduit 161.

The pump motor 164 may produce the rotational force based on a driving current applied from the second driver 300.

The pump motor 164 may include, for example, a BLDC motor or a PMSM capable of easily controlling the rotation speed.

In the case of the top-loading washing machine as shown in FIG. 1, the water level sensor 170 may be installed at an end of a connecting hose 171 connected to the bottom of the tub 120. In this case, a water level in the connecting hose 171 may be equivalent to a water level in the tub 120. As the water level in the tub 120 increases, the water level in the connecting hose 171 increases, and due to the increase of the water level in the connecting hose 171, internal pressure of the connecting hose 171 may increase.

The water level sensor 170 may measure pressure in the connecting hose 171 and output an electric signal corresponding to the measured pressure to the controller 190. The controller 190 may identify a water level in the connecting hose 171, i.e., a water level in the tub 120, based on the pressure in the connecting hose 171 measured by the water level sensor 170 or 175.

In an embodiment, the controller 190 may identify the water level in the tub 120 by analyzing a frequency (water level frequency) of the electric signal corresponding to the pressure measured by the water level sensor 170.

In the case of the front-loading washing machine as shown in FIG. 2, the water level sensor 175 may be installed on the inner side of the bottom of the tub 120. As the water level in the tub 120 increases, the pressure applied to the water level sensor 175 increases, and accordingly, the water level sensor 175 may detect a frequency changing by the water level when the drum 130 rotates.

In an embodiment, the controller 190 may identify the water level in the tub 120 by analyzing a frequency (water level frequency) of the electric signal corresponding to the pressure measured by the water level sensor 175.

In various embodiments, the washing machine 100 may include the vibration sensor 180 for detecting vibration of the tub 120. The vibration sensor 180 may be installed in various positions (e.g., in the tub 120 or the cabinet 101) at which to detect vibration of the tub 120.

The vibration sensor 180 may include an acceleration sensor for measuring 3-axis (X, Y and Z) acceleration of the tub 120. For example, the vibration sensor 180 may be provided as a piezoelectric type, strain gauge type, piezoresistive type, capacitive type, servo type, or optical type acceleration sensor. In addition, the vibration sensor 180 may be provided as various sensors (e.g., gyroscope) capable of measuring vibration of the tub 120.

The vibration sensor 180 may output a sensing value of the vibration of the tub 120. For example, the vibration sensor 180 may output a constant value corresponding to the vibration of the tub 120. The vibration sensor 180 may output a voltage value corresponding to the 3-axis acceleration of the tub 120.

In various embodiments, the vibration sensor 180 may be provided as a micro electro mechanical system (MEMS) sensor. An MEMS is a scheme developed with the advancement of semiconductor technologies, and the MEMS sensor may be made by deposition, photolithographic patterning and etching processes. The vibration sensor 180 may be formed of various materials such as silicon, polymer, metal or ceramic. The vibration sensor manufactured in the MEMS scheme may have a size in micrometers.

The controller 190 may determine an amount of vibration of the tub 120 based on a vibration signal received from the vibration sensor 180, and control rotation speed of the driving motor 140 and/or rotation speed of the pump motor 164 based on the amount of vibration of the tub 120.

For example, the controller 190 may be mounted on a printed circuit board provided on the rear surface of the control panel 110.

The controller 190 may be electrically connected to the control panel 110, the water level sensor 170 or 175, the vibration sensor 180, the drivers 200 and 300, the water supply valve 152 and the drain valve 162.

The controller 190 may be comprised of hardware such as a control processing unit (CPU), a memory, etc., and software such as a control program. The controller 190 may be implemented to include at least one memory 192 that stores an algorithm for controlling operations of the components in the washing machine 100, and at least one processor 191 for performing the aforementioned operations using the data stored in the at least one memory 192. In this case, the memory 192 and the processor 191 may be implemented in separate chips. Alternatively, the memory 192 and the processor 191 may be implemented in a single chip.

The processor 191 may process output signals from the control panel 110, the water level sensor 170 or 175, the vibration sensor 180 and/or the drivers 200 and 300, and include an operation circuit, a memory circuit, and a control circuit, which output control signals to the drivers 200 and 300, the water supply valve 152 and the drain valve 162 based on the processing results.

The memory 192 may include a volatile memory, such as a static random access memory (S-RAM), a dynamic RAM (D-RAM), or the like, and a non-volatile memory, such as a read only memory (ROM), an erasable programmable ROM (EPROM) or the like.

The controller 190 may control the various components (e.g., the driving motor 140 and the pump motor 164) of the washing machine 100, and automatically drive the respective courses such as water supply, washing, rinsing, dehydrating, etc., according to an indication input to the control panel 110.

For example, the controller 190 may control the first driver 200 to control the rotation speed (hereinafter, operating revolutions per minute (rpm)) of the driving motor 140, and control the second driver 300 to control the operating rpm of the pump motor 164.

In various embodiments, the controller 190 may control the operating rpm of the driving motor 140 and/or the operating rpm of the pump motor 164 based on information about a water level in the tub 120 received from the water level sensor 170 or 175, information about an amount of vibration of the tub 120 obtained by the vibration sensor 180, information about the operating rpm of the driving motor 140 received from the first driver 200, and/or information about the operating rpm of the pump motor 164 received from the second driver 300.

Figure 4:
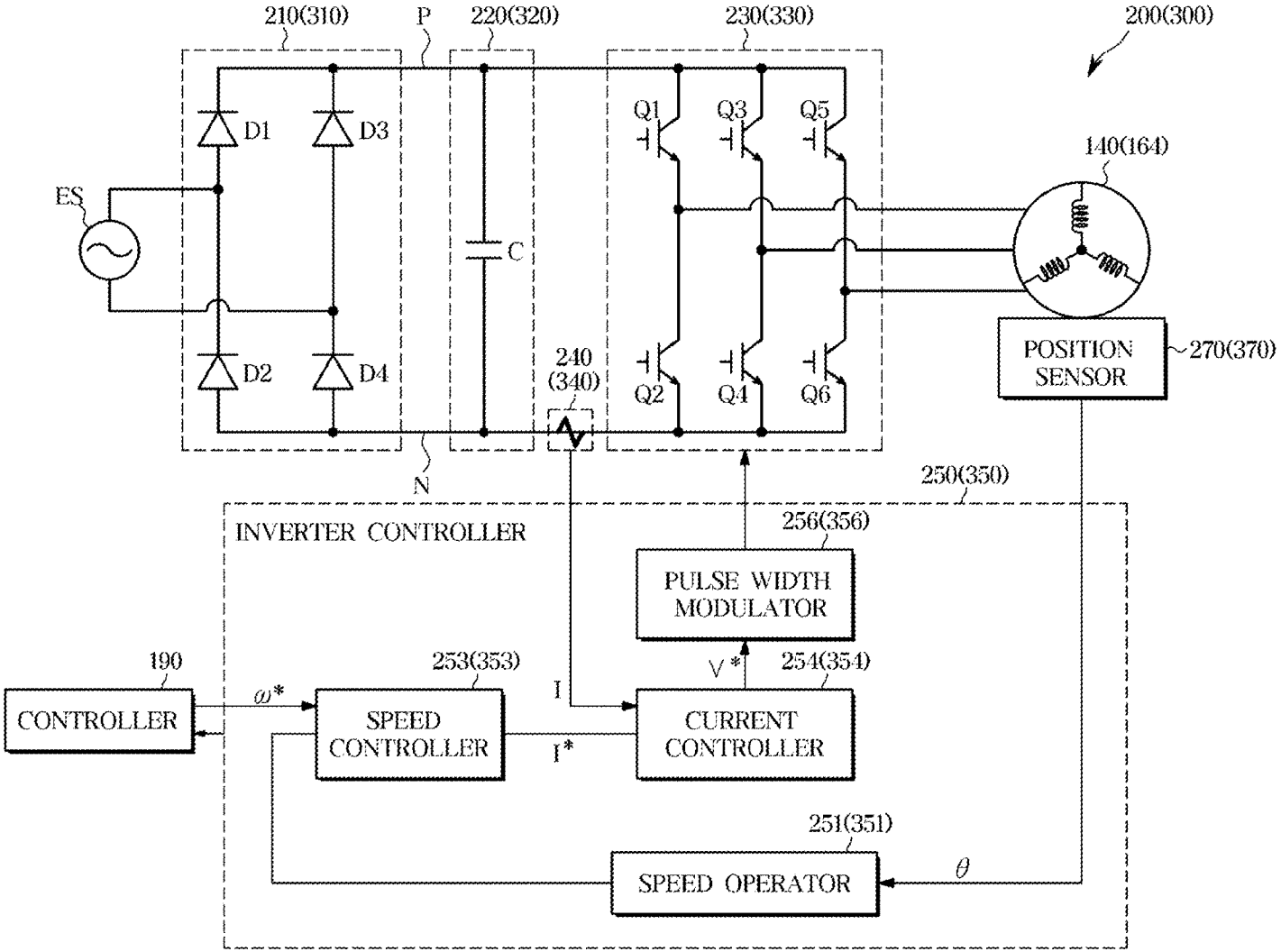
FIG. 4 illustrates an example of a driver for driving a pump motor and/or a driving motor of a washing machine, according to an embodiment.
Figure 5:
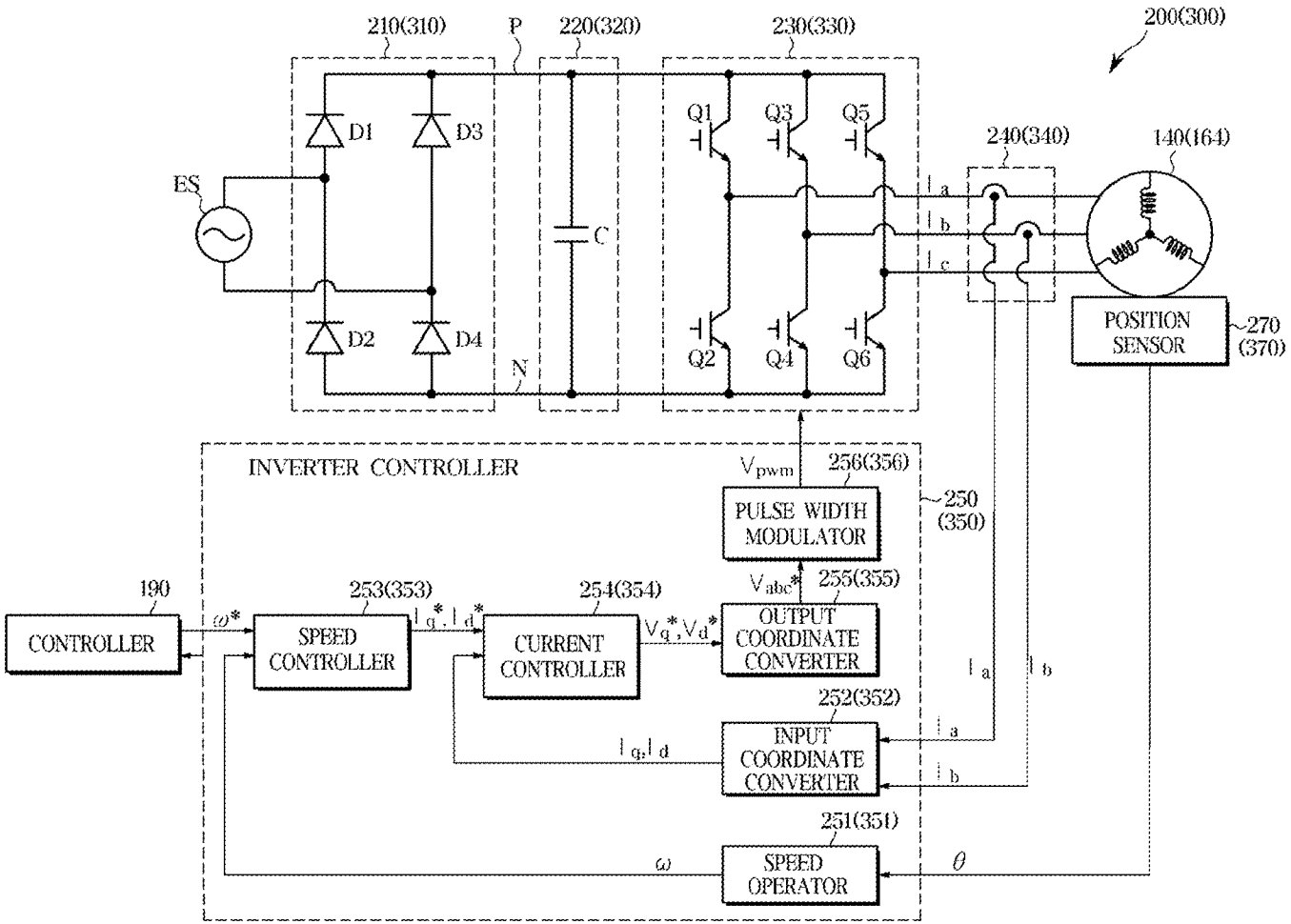
FIG. 5 illustrates another example of a driver for driving a pump motor and/or a driving motor of a washing machine, according to an embodiment.

FIG. 4 illustrates an example of a driver for driving a pump motor and/or a driving motor of a washing machine, according to an embodiment. FIG. 5 illustrates another example of a driver for driving a pump motor and/or a driving motor of a washing machine, according to an embodiment.

For convenience of explanation, the first driver 200 and the second driver 300 may be collectively defined as the driver 200 or 300, and configurations that the first driver 200 and the second driver 300 have in common will now be described. In FIGS. 4 and 5, it is assumed that components of the first driver 200 have reference numerals starting with number 2, and components of the second driver 300 have reference numerals starting with number 3.

Referring to FIGS. 4 and 5, the driver 200 or 300 may include a rectifying circuit 210 or 310, a direct current (DC) link circuit 220 or 320, an inverter circuit 230 or 330, a current sensor 240 or 340, and/or an inverter controller 250 or 350. A position sensor 270 or 370 may be arranged on the motor 140 or 164 for measuring rotational displacement of the rotor (electrical angle of the rotor).

The rectifying circuit 210 or 310 may include a diode bridge including a plurality of diodes D1, D2, D3 and D4 to rectify alternate current (AC) power from an external power source (ES).

The DC link circuit 220 or 320 may include a DC link capacitor C for storing electrical energy to get rid of ripples of the rectified power and output DC power.

The inverter circuit 230 or 330 may include three pairs of switching devices Q1 and Q2, Q3 and Q4, and Q5 and Q6 to convert the DC power from the DC link circuit 220 or 320 to DC or AC driving power. The inverter circuit 230 or 330 may apply a driving current to the motor 140 or 164.

The current sensor 240 or 340 may measure a total current output from the inverter circuit 230 or 330 or measure each of three-phase driving currents, a-phase current, b-phase current and c-phase current output from the inverter circuit 230 or 330.

The position sensor 270 or 370 may be arranged on the motor 140 or 164 for measuring rotational displacement of the rotor of the motor 140 or 164 (e.g., electric angle of the rotor) and output position data Θ that represents the electric angle of the rotor. The position sensor 270 or 370 may be implemented by a hall sensor, an encoder, a resolver, or the like.

The inverter controller 250 or 350 may be integrated into the controller 190 or separated from the controller 190.

The inverter controller 250 or 350 may include an application specific integrated circuit (ASIC) for outputting a driving signal to the inverter circuit 230 or 330 based on e.g., a target speed command ω*, a driving current value, and the rotational displacement Θ of the rotor 143. Alternatively, the inverter controller 250 or 350 may include a memory for storing a series of instructions for outputting a driving signal based on a target speed command ω*, a driving current value, and rotational displacement Θ of the rotor, and a processor for processing the series of instructions stored in the memory.

The structure of the inverter controller 250 or 350 may depend on the type of the motor 140 or 164. In other words, the inverter controller 250 or 350 having a different structure may control the motor 140 or 164 of a different type.

For example, when the motor 140 or 160 is a BLDC motor, the inverter controller 250 or 350 may include a speed operator 251 or 351, a speed controller 253 or 353, a current controller 254 or 354, and a pulse width modulator 256 or 356, as shown in FIG. 5.

The inverter controller 250 or 350 may use pulse width modulation (PWM) to control a DC voltage applied to the BLDC motor. Accordingly, the driving current applied to the BLDC motor may be controlled.

The speed operator 251 or 351 may calculate a rotation speed value ω of the motor 140 or 164 based on the electric angle θ of the rotor of the motor 140 or 164. For example, the speed operator 251 or 351 may calculate the rotation speed value ω of the motor 140 or 164 based on a change in electric angle θ of the rotor received from the position sensor 270 or 370. In another example, the speed operator 251 or 351 may calculate the rotation speed value ω of the motor 140 or 164 based on a change in driving current value measured by the current sensor 240 or 340.

The speed controller 253 or 353 may output a current command I* based on a difference between the target speed command ω* of the controller 190 and the rotation speed value ω of the motor 140 or 164. For example, the speed controller 253 or 353 may include a proportional integral controller (PI controller).

The current controller 254 or 354 may output a voltage command V* based on a difference between the current command I* output from the speed controller 253 or 353 and the current value I measured by the current sensor 240 or 340. For example, the current controller 254 or 354 may include PI control.

The pulse width modulator 256 or 356 may output a PWM control signal Vpwm to control the magnitude of the driving current applied to the motor 140 or 164 by the inverter circuit 230 or 330 based on the voltage command V*.

As such, the inverter controller 250 or 350 may control the magnitude of the driving current applied to the motor 140 or 164 by the inverter circuit 230 or 330 based on the target speed command ω* received from the controller 190.

In another example, when the motor 140 or 160 is a PMSM, the inverter controller 250 or 350 may include the speed operator 251 or 351, an input coordinate converter 252 or 352, the speed controller 253 or 353, the current controller 254 or 354, an output coordinate converter 255 or 355 and the pulse width modulator 256 or 356, as shown in FIG. 5.

The inverter controller 250 or 350 may use vector control to control the AC voltage applied to the PMSM. Accordingly, the driving current applied to the PMSM may be controlled.

The speed operator 251 or 351 may be equivalent to the speed operator 251 or 351 shown in FIG. 4.

The input coordinate converter 252 or 352 may convert a 3-phase driving current value Iabc into a d-axis current value Id and q-axis current value Iq (hereinafter, a d-axis current and a q-axis current) based on the electric angle θ of the rotor. In this case, the d-axis may refer to an axis in a direction corresponding to a direction of a magnetic field produced by the rotor of the motor 140 or 164. The q-axis may refer to an axis in a direction ahead by 90 degrees of a direction of the magnetic field produced by the rotor of the motor 140 or 164.

The speed controller 253 or 353 may calculate a q-axis current command Iq* to be applied to the motor 140 or 164 based on a difference between the target speed command ω* and the rotation speed value ω of the motor 140 or 164. The speed controller 253 or 353 may determine a d-axis current command Id*.

The current controller 254 or 354 may determine a q-axis voltage command Vq* based on a difference between the q-axis current command Iq* output from the speed controller 253 or 353 and the q-axis current value Iq output from the input coordinate converter 252 or 352. The current controller 254 or 354 may determine a d-axis voltage command Vd* based on a difference between the d-axis current command Id* and the d-axis current value Id.

The output coordinate converter 255 and 355 may convert a dq axis voltage command Vdq* into 3-phase voltage commands (an a-phase voltage command, a b-phase voltage command, and a c-phase voltage command) Vabc* based on the electric angle Θ of the rotor of the motor 140 or 164.

The pulse width modulator 256 or 356 may output a PWM control signal Vpwm to control the magnitude of the driving current applied to the motor 140 or 164 by the inverter circuit 230 or 330 based on the 3-phase voltage command Vabc*.

As such, the inverter controller 250 or 350 may control the magnitude of the driving current applied to the motor 140 or 164 by the inverter circuit 230 or 330 based on the target speed command ω* received from the controller 190.

In various embodiments, the driver 200 or 300 may include a voltage sensor (not shown) for measuring a driving voltage applied to the motor 140 or 164. The driver 200 or 300 may further include a power operator (not shown) for computing power to be applied to the motor 140 or 164 based on a voltage value output from a voltage sensor and a current value output from the current sensor 240 or 340, and a power controller (not shown) for outputting a target speed command ω* according to power computed by the power operator and a target power command output from the controller 190.

The power controller may include a PI controller.

In various embodiments, the controller 190 may output a target power command to the inverter controller 250 or 350, which may in turn control the inverter circuit 230 or 330 to supply target power to the motor 140 or 164 based on the target power command. Accordingly, the controller 190 may perform power control and speed control on the motor 140 or 164.

The controller 190 may receive information about the operating rpm of the motor 140 or 164 from the inverter controller 250 or 350.

Figure 6:
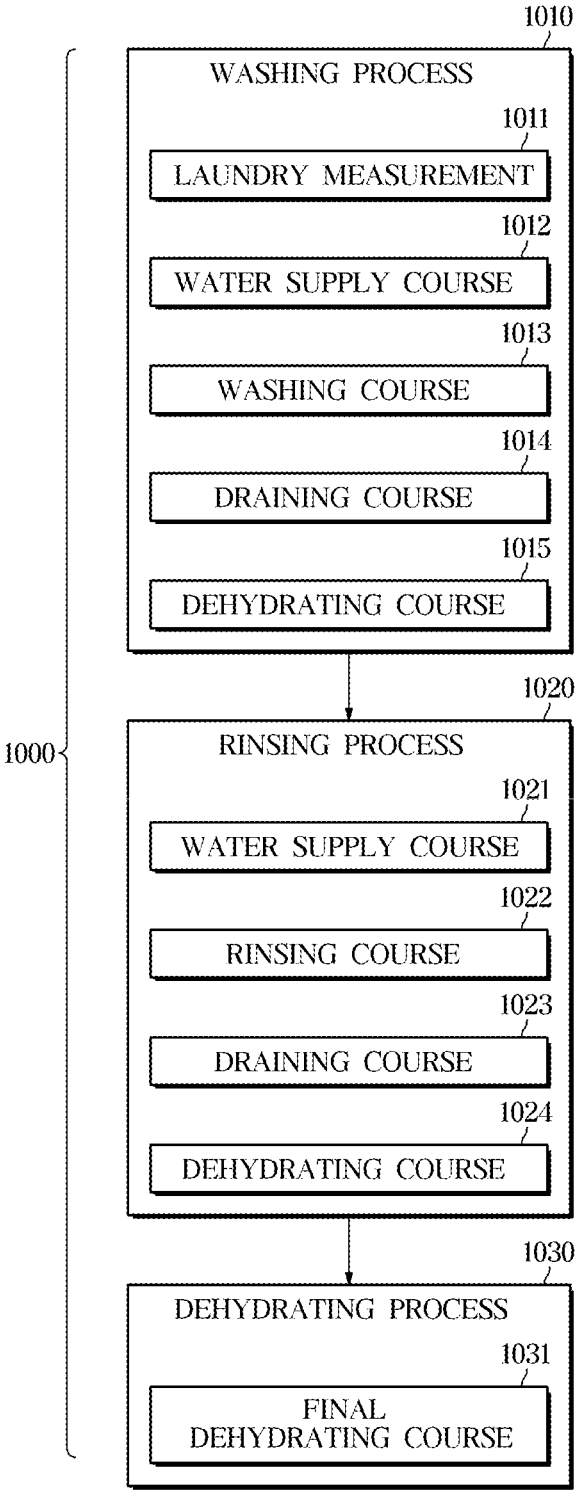
FIG. 6 illustrates an example of a laundry cycle of a washing machine, according to an embodiment.

FIG. 6 illustrates an example of a laundry cycle of a washing machine, according to an embodiment.

Referring to FIG. 6, in an embodiment, a laundry cycle 1000 of the washing machine 100 may be comprised of a washing process 1010, a rinsing process 1020 and a dehydrating process 1030.

The washing machine 100 may perform the washing process 1010, the rinsing process 1020 and the dehydrating process 1030 sequentially according to a user input through the control panel 110.

Clothes may be washed by the washing process 1010. Specifically, dirt on the clothes may be separated by chemical actions of a detergent and/or mechanical actions such as falling.

The washing process 1010 may include laundry measurement 1011 for measuring an amount of clothes, a water supply course 1012 for supplying water to the tub 120, a washing course 1013 for washing the clothes by rotating the drum 130 at low speed, a draining course 1014 for draining water contained in the tub 120, and a dehydrating course 1015 for separating water from the clothes by rotating the drum 130 at high speed.

In the water supply course 1012, a detergent contained in the detergent container 156 may be supplied to the tub 120 by the detergent supplier 155.

For the washing course 1013, the controller 190 may control the first driver 200 to rotate the driving motor 140 in forward direction or reverse direction. In the case of the front-loading washing machine, the clothes may fall from the upper side to the lower side of the drum 130 due to rotation of the drum 130 and may be washed by the falling, and in the case of the top-loading washing machine, clothes may be washed by centrifugal force produced by rotation of the drum 130.

For the draining course 1014, the controller 190 may control the second driver 300 to rotate the pump motor 164. The rotation of the pump motor 164 may cause a difference in pressure between both sides of the drain pump 163, allowing the water in the tub 120 to be drained to the outside.

For the dehydrating course 1015, the controller 190 may control the first driver 200 to rotate the driving motor 140 at high speed. Due to the high-speed rotation of the drum 130, water may be separated from the clothes contained in the drum 130. Furthermore, to discharge the remaining water in the tub 120 to the outside during the dehydrating course 1015, the controller 190 may control the second driver 300 to rotate the pump motor 164.

The rotation speed of the drum 130 may gradually increase during the dehydrating course 1015. For example, the controller 190 may control the first driver 200 to rotate the driving motor 140 at a first rotation speed, and the driving motor 140 may be controlled so that the rotation speed of the driving motor 140 increases to a second rotation speed based on a change in driving current of the driving motor 140 while the driving motor 140 is rotated at the first rotation speed. The controller 190 may control the driving motor 140 so that the rotation speed of the driving motor 140 increases to a third rotation speed or the rotation speed of the driving motor 140 decreases to the first rotation speed based on a change in driving current of the driving motor 140 while the driving motor 140 is rotated at the second rotation speed.

In various embodiments, during the dehydrating course 1015, the rotation speed of the pump motor 164 may be changed based on the rotation speed of the driving motor 140.

The clothes may be rinsed by the rinsing process 1020. Specifically, the remnants of the detergent or dirt on the clothes may be washed by water.

The rinsing process 1020 may include a water supply course 1021 for supplying water to the tub 120, a rinsing course 1022 for rinsing the clothes by driving the drum 130, a draining course 1023 for draining water contained in the tub 120, and a dehydrating course 1024 for separating water from the clothes by driving the drum 130.

The water supply course 1021, draining course 1023 and dehydrating course 1024 of the rinsing process 1020 may correspond to the water supply course 1012, draining course 1014 and dehydrating course 1015 of the washing process 1010. During the rinsing process 1020, the water supply course 1021, the rinsing course 1022, the draining course 1023 and the dehydrating course 1024 may be performed one or multiple times.

The clothes may be dehydrated by the dehydrating process 1030. Specifically, water may be separated from the clothes by high-speed rotation of the drum 130, and the separated water may be discharged out of the washing machine 100.

The dehydrating process 1030 may include a final dehydrating course 1031 to separate water from the clothes by rotating the drum 130 at high speed. With the final dehydrating course 1031, the last dehydrating course 1024 of the rinsing process 1020 may be skipped.

For the final dehydrating course 1031, the controller 190 may control the first driver 200 to rotate the driving motor 140 at high speed. Due to the high-speed rotation of the drum 130, moisture may be separated from the clothes contained in the drum 130. Furthermore, to discharge the remaining water in the tub 120 to the outside during the final dehydrating course 1031, the controller 190 may control the second driver 300 to rotate the pump motor 164.

The rotation speed of the driving motor 140 may gradually increase during the final dehydrating course 1031.

In various embodiments, during the final dehydrating course 1031, the rotation speed of the pump motor 164 may be changed based on the rotation speed of the driving motor 140.

As the operation of the washing machine 100 is finished with the final dehydrating course 1031, a performance time of the final dehydration 1031 may be longer than a performance time of the dehydration course 1015 of the washing process 1010 and the dehydration course 1024 of the rinsing process 1020.

Figure 7:
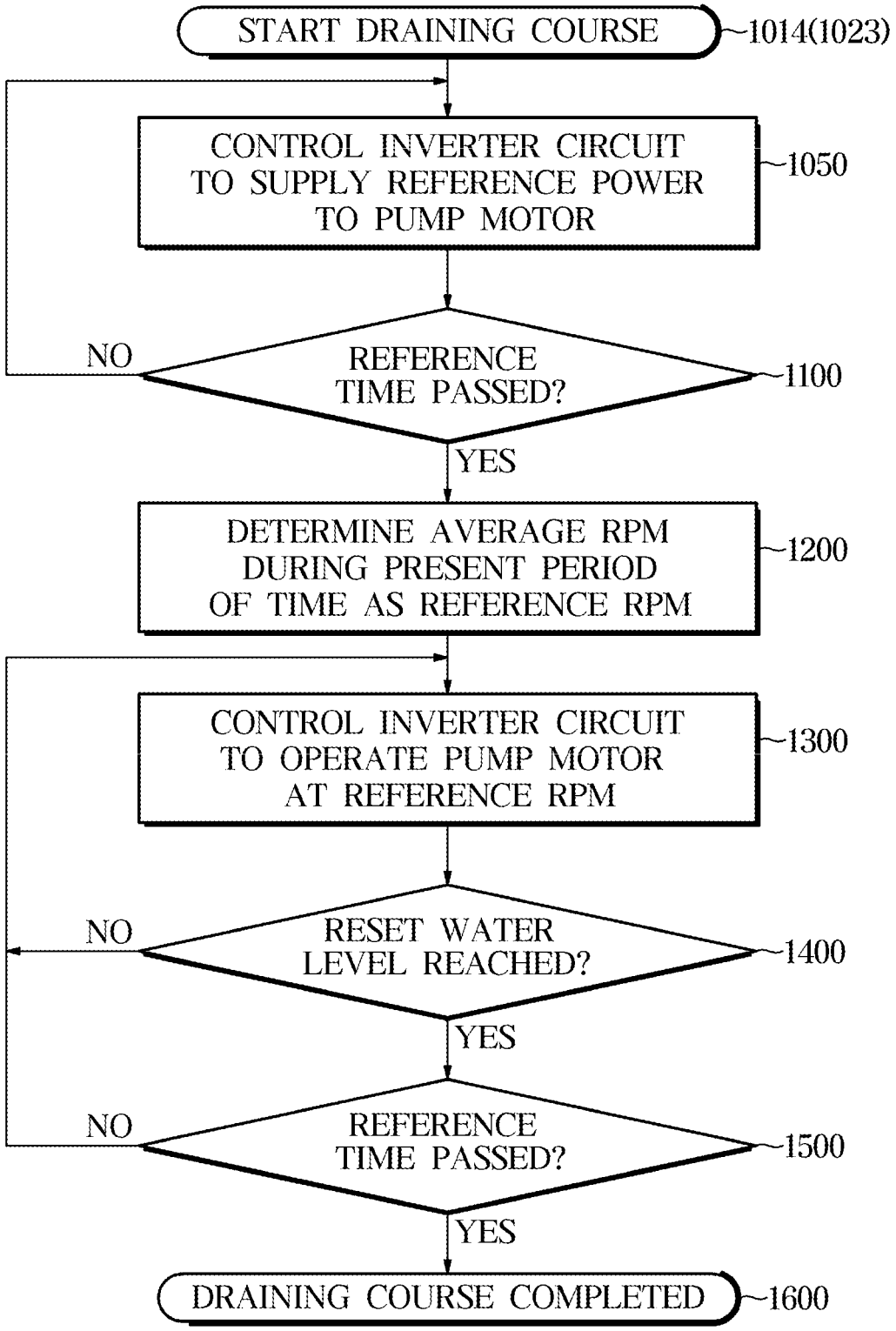
FIG. 7 is a flowchart illustrating an example of a method of controlling a washing machine during a draining course, according to an embodiment.
Figure 8:
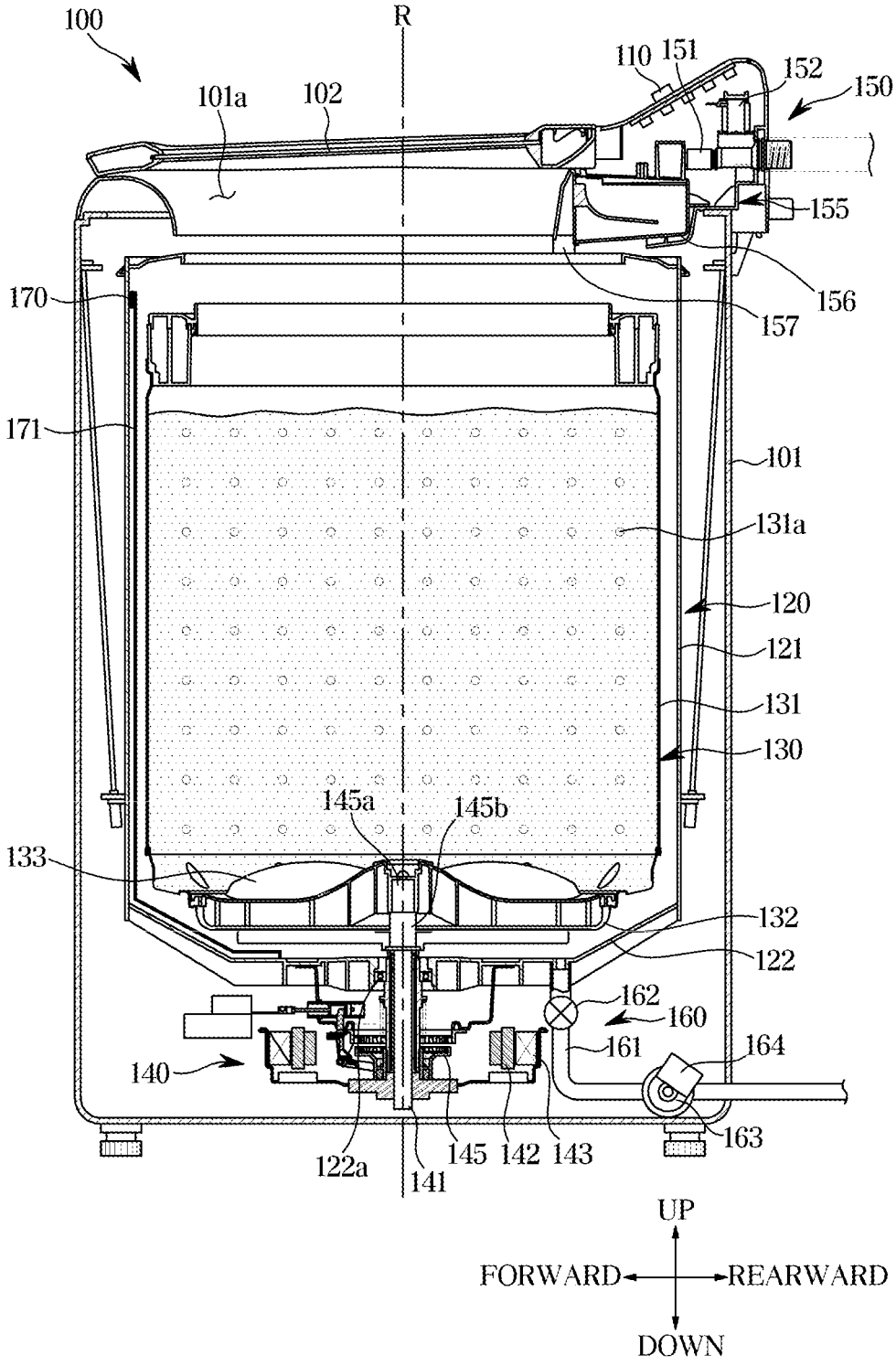
FIG. 8 illustrates a water level in a tub after completion of a water supply course of a washing machine, according to an embodiment.
Figure 9:
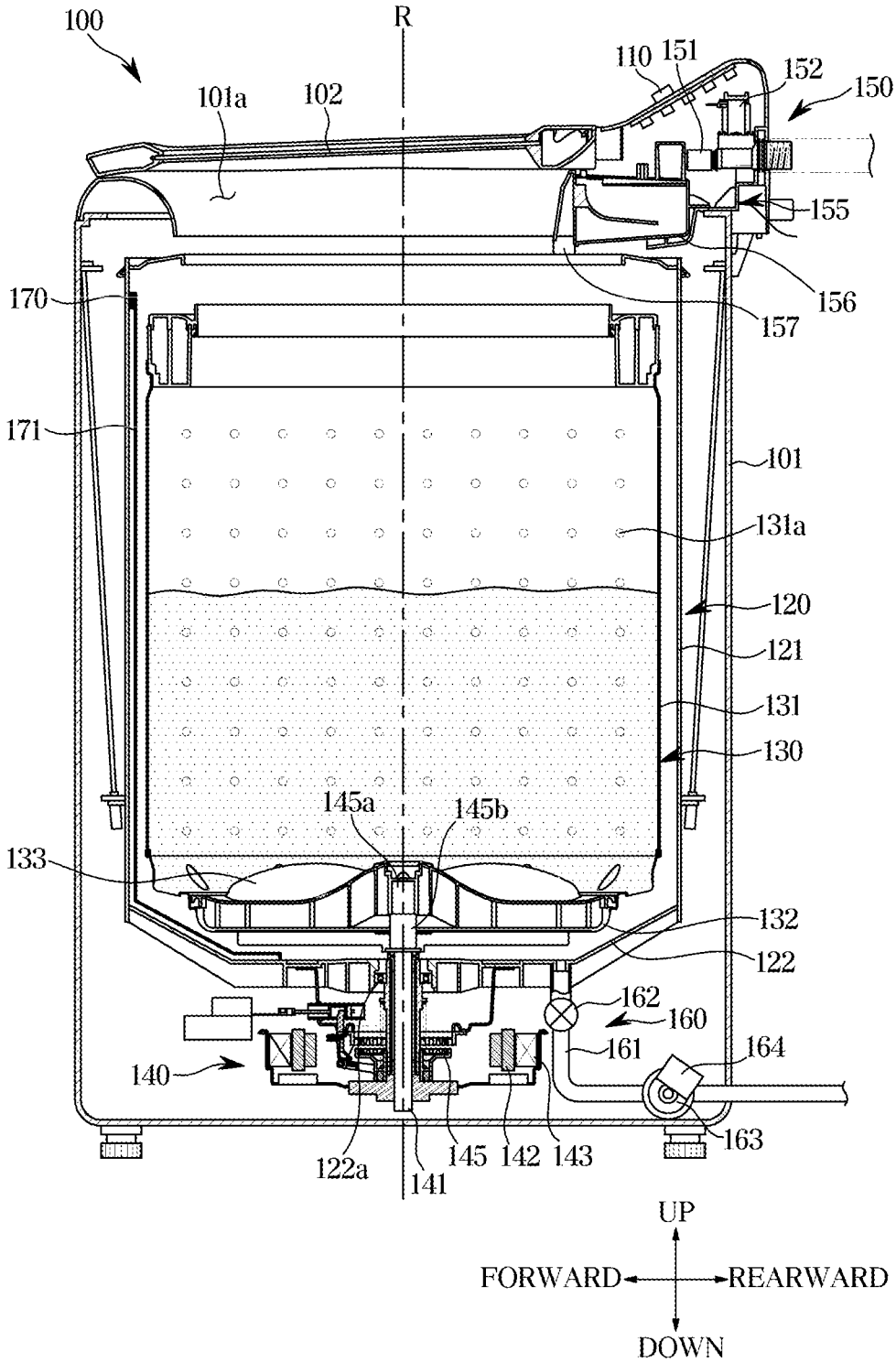
FIG. 9 illustrates a water level in a tub during a draining course of a washing machine, according to an embodiment.
Figure 10:
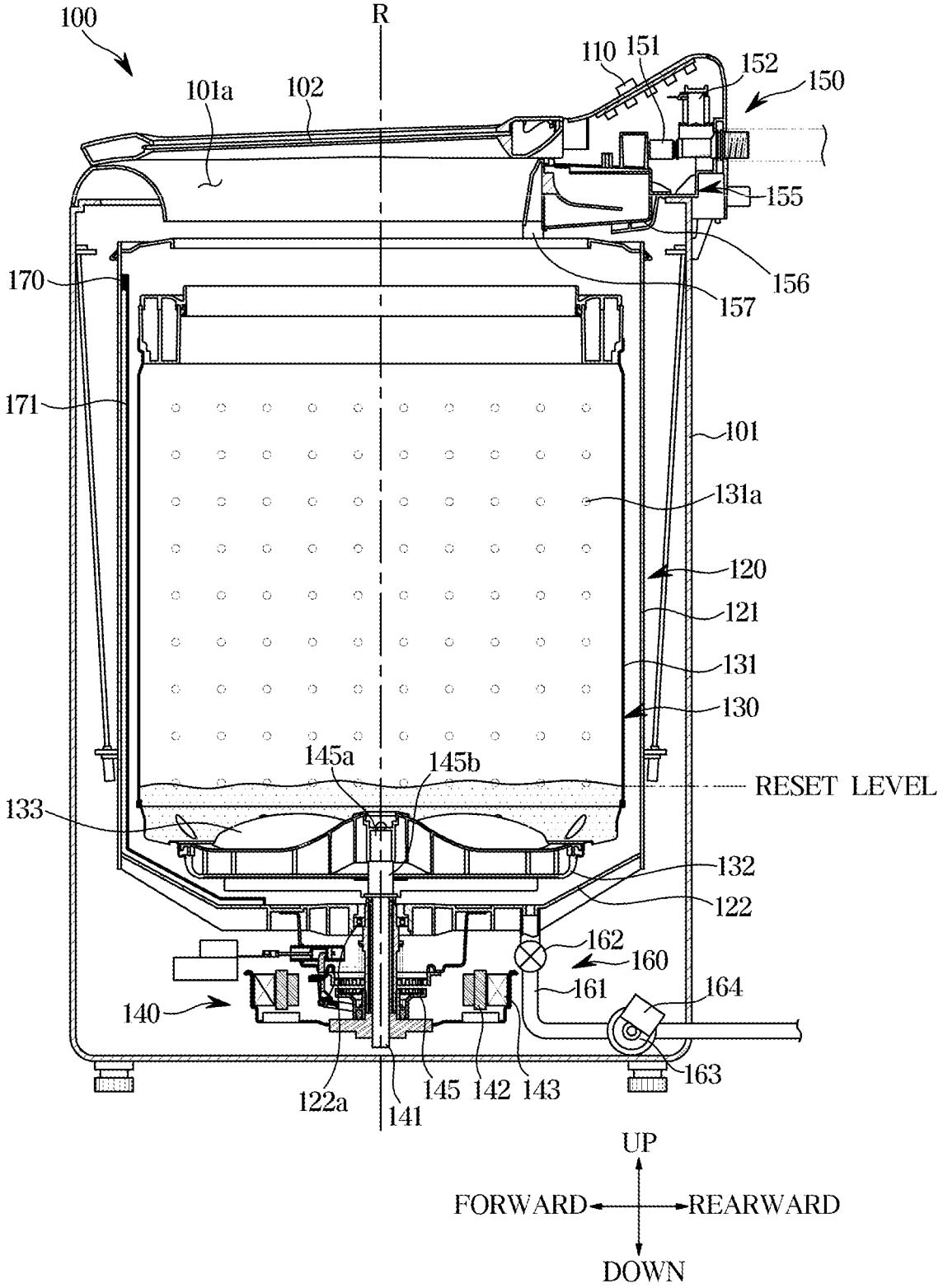
FIG. 10 illustrates a water level in a tub reaching a reset water level during a draining course of a washing machine, according to an embodiment.

FIG. 7 is a flowchart illustrating an example of a method of controlling a washing machine during a draining course, according to an embodiment. FIG. 8 illustrates a water level in a tub after completion of a water supply course of a washing machine, according to an embodiment. FIG. 9 illustrates a water level in a tub during a draining course of a washing machine, according to an embodiment. FIG. 10 illustrates a water level in a tub reaching a reset water level during a draining course of a washing machine, according to an embodiment.

Referring to FIG. 7, the controller 190 may control the inverter circuit 230 or 330 to supply reference power to the pump motor 164 at the start of the draining course 1014 or 1023, in 1050.

For example, the controller 190 may control the inverter circuit 230 or 330 to supply reference power to the pump motor 164 by delivering a target power command corresponding to the reference power to the second driver 300.

In this case, the reference power value may be stored in the memory 192, and may imply a maximum power value for rotating the pump motor 164 at the highest speed.

In an embodiment, the controller 190 may control the inverter circuit 230 or 330 to supply reference power to the pump motor 164 in operation 1050 by delivering a target speed command corresponding to the reference power to the second driver 300.

In this case, the target speed value corresponding to the reference power may be stored in the memory 192.

After the passage of a reference time from a time when the draining course 1014 or 1023 begins, i.e., a time when the inverter circuit 230 or 330 is controlled to supply the reference power to the pump motor 164, in operation 1100, the controller 190 may determine reference rpm based on average rpm of the pump motor 164 during a preset period of time, in operation 1200.

In this case, the reference time may be a time determined in advance based on a gap between when the inverter circuit 230 or 330 is controlled to supply the reference power to the pump motor 164 and when the reference power is supplied to the pump motor 164, and may be stored in the memory 192. For example, the controller 190 may determine the reference time based on a difference between when the inverter circuit 230 or 330 is controlled to supply the reference power to the pump motor 164 and when the reference power is supplied to the pump motor 164. For example, the reference time may be determined to be about 10 seconds.

Furthermore, the preset period of time may be set as a period of time to ensure reliability of the operating rpm of the pump motor 164, and stored in the memory 192. For example, the preset period of time may be determined to be about 5 seconds.

Specifically, the controller 190 may control the inverter circuit 230 or 330 to supply the reference power to the pump motor 164 at the start of a draining course, receive information about the operating rpm of the pump motor 164 for the preset period of time from after the passage of the reference time, and determine an average value of the operating rpm of the pump motor 164 for the preset period of time as the reference rpm.

In this case, the reference rpm may refer to rpm that is a reference for later operation of the pump motor 164, and refer to operating rpm of the pump motor 164 at which minimal vibration and noise is created with optimal efficiency. The reference rpm will be described in detail with reference to FIGS. 11 to 14.

The controller 190 may control the inverter circuit 230 or 330 to operate the pump motor 164 at the reference rpm in response to the determining of the reference rpm, in operation 1300. For example, the controller 190 may output a target speed command $\omega^*$ corresponding to the reference rpm.

In various embodiments, the controller 190 may control the inverter circuit 230 or 330 to operate the pump motor 164 at the reference rpm as soon as the reference rpm is determined.

Referring to FIG. 8, when a draining course begins, a water level in the tub 120 may be almost equal to a target water level determined based on the weight of clothes determined in the laundry measurement course 1011.

In the embodiment, the controller 190 may control the operating rpm of the pump motor 164 to the reference rpm while the water level in the tub 120 is not much lowered, e.g., in the state as shown in FIG. 9, because the controller 190 may determine the reference rpm when a certain time (reference time+a preset period of time) passes after the start of a draining course.

Referring to FIG. 9, it may be seen that the water level in the tub 120 is not much lowered as compared to the water level in the tub 120 as shown in FIG. 8. As such, in the embodiment, after the passage of a minimum time after a draining course begins, the operating rpm of the pump motor 164 may be controlled to the reference rpm, which is optimal rpm, thereby preventing occurrence of noise and vibration due to operation of the pump motor 164.

The controller 190 may control the inverter circuit 230 or 330 to operate the pump motor 164 at the reference rpm before the reference time passes in operation 1500 after the water level in the washing tub 120 reaches the reset water level in operation 1400. In this case, the reference time may be set to a time to discharge as much water as the reset water level to the outside, and stored in the memory 192. For example, the reference time may be set to about 2 minutes. After the reference time passes the draining course is completed in operation 1600.

Referring to FIG. 10, the water level in the tub 120 may be identified as corresponding to the reset water level. The reset water level is a threshold water level with low reliability of a measurement value obtained by the water level sensor, and the value of the reset water level may be stored in the memory 192 in advance. For example, the reset water level may be set to about 10 mm to about 30 mm.

When the reference time passes in operation 1500 after the water level in the tub 120 reaches the reset water level, the controller 190 may determine that the draining course is completed in operation 1600 and start the dehydrating course 1015 or 1024.

In various embodiments, it may be determined based on the water level in the tub 120 reaching the reset water level that the draining course is completed, and even when a dehydrating course begins accordingly, the controller 190 may control the inverter circuit 230 or 330 to operate the pump motor 164 at the reference rpm before the reference time passes.

According to the disclosure, without addition of hardware or a requirement for a complicated algorithm, optimal operating rpm of the pump motor 164 may be determined by simply using average rpm of the pump motor 164 during the preset period of time, thereby reducing vibration and noise that may occur in the draining course.

Figure 11:
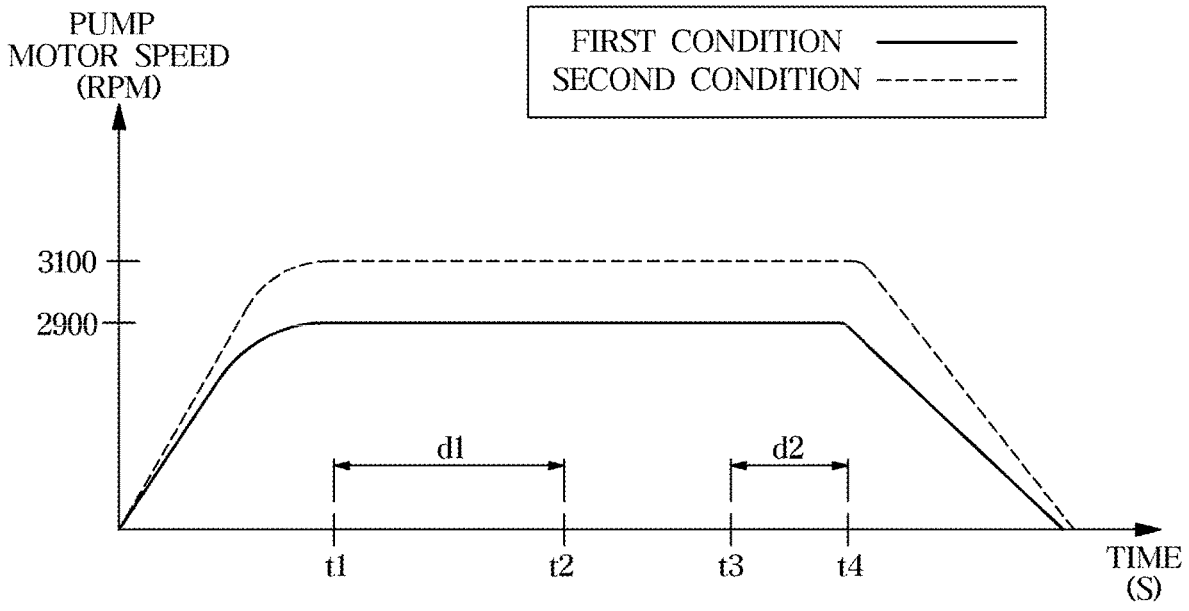
FIG. 11 illustrates operating revolutions per minute (rpm) of a pump motor depending on different conditions of a washing machine, according to an embodiment.
Figure 12:
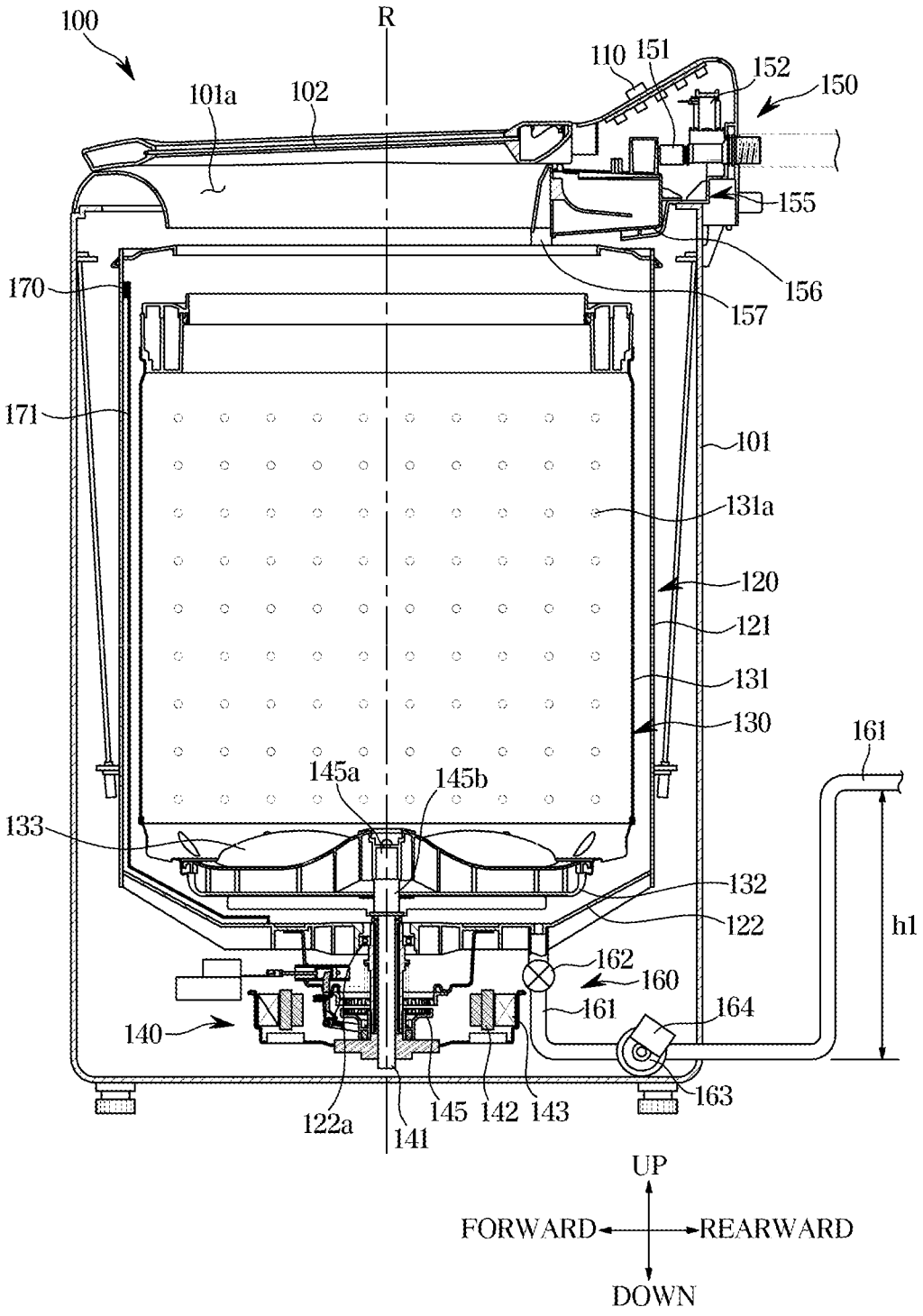
FIG. 12 illustrates an occasion when a water drainage height of a washing machine has a first value, according to an embodiment.
Figure 13:
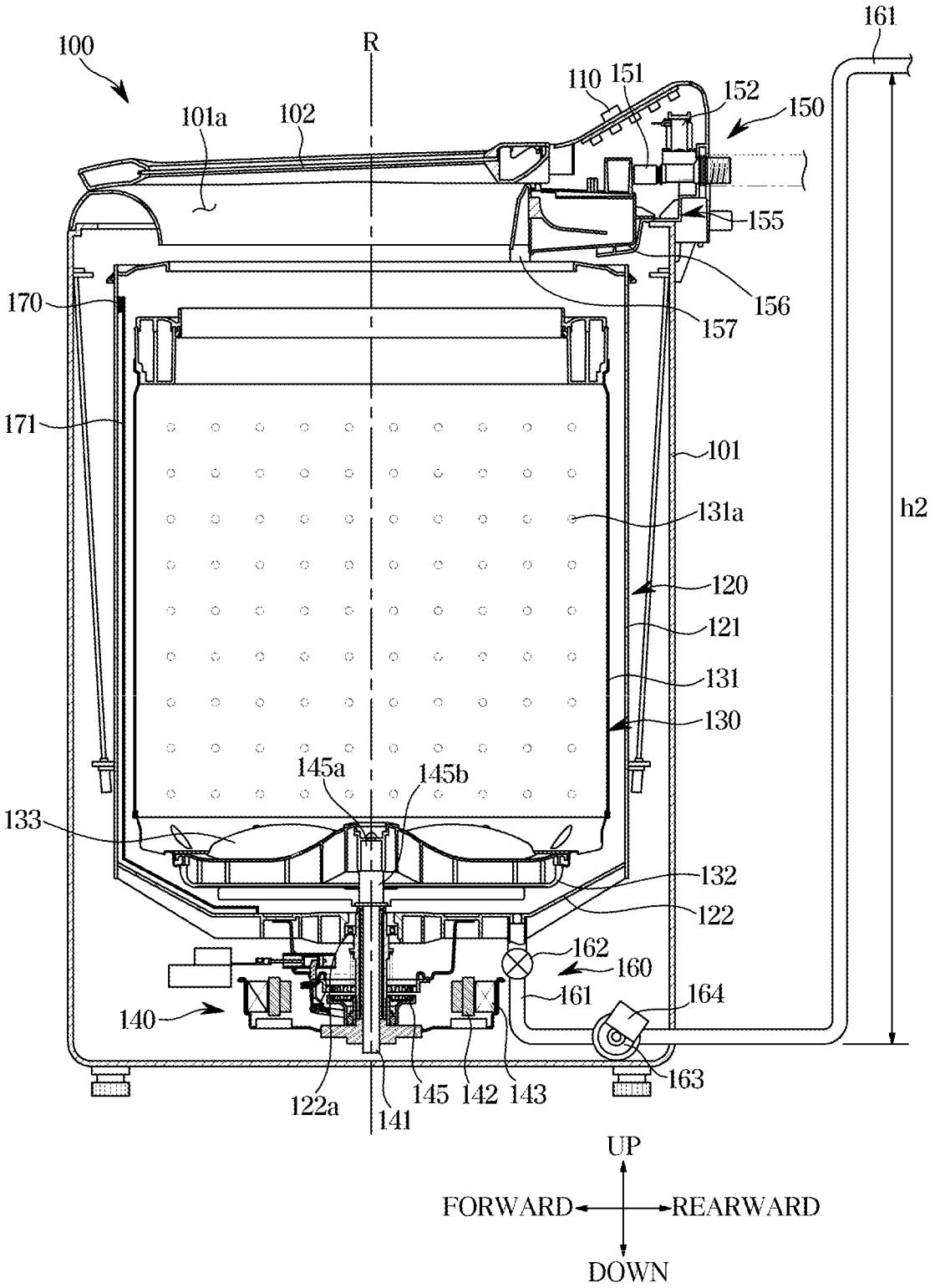
FIG. 13 illustrates an occasion when a water drainage height of a washing machine has a second value, according to an embodiment.
Figure 14:
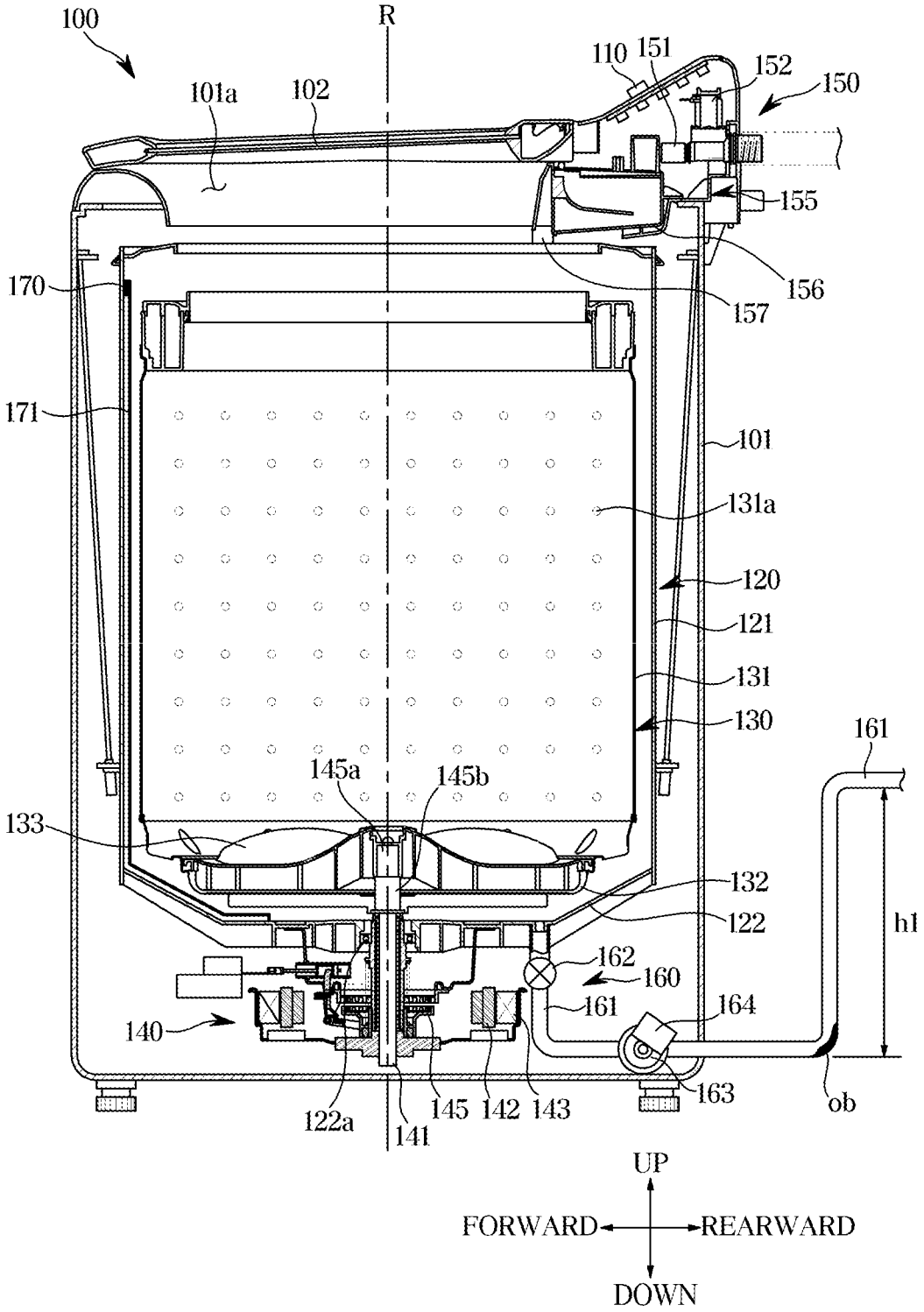
FIG. 14 illustrates a situation when a drain conduit of a washing machine is blocked by dirt, according to an embodiment.

FIG. 11 illustrates operating rpm of a pump motor depending on different conditions of a washing machine, according to an embodiment. FIG. 12 illustrates an occasion when a water drainage height of a washing machine has a first value, according to an embodiment. FIG. 13 illustrates an occasion when a water drainage height of a washing machine has a second value, according to an embodiment. FIG. 14 illustrates a situation when a drain conduit of a washing machine is blocked by dirt, according to an embodiment.

Referring to FIG. 11, it may be seen that operating rpm of the pump motor 164 may vary depending on different conditions of the washing machine 100. The different conditions of the washing machine 100 may include installation conditions (e.g., drainage heights) of the washing machine 100 or conditions of the drain pump 163 (e.g., blockage of the drain conduit 161).

The controller may control the inverter circuit 230 or 330 to supply the reference power to the pump motor 164 at the start of the draining course 1014 or 1023, in which case the average rpm of the pump motor 164 during a preset period of time d1 from a time t1 after the passage of a reference time may be changed depending on the condition of the washing machine 100.

For example, a head of fluid (hereinafter, drainage height) which refers to a vertical height of the drain conduit 161 may be different depending on the installation condition of the washing machine 100.

Referring to FIG. 12, the drainage height may be shown as being first height h1, and referring to FIG. 13, the drainage height may be shown as being second height h2, which is higher than the first height h1.

In this case, depending on the installation condition of the washing machine 100, the first height h1 may be about 3 feet and the second height h2 may be about 9 feet, without being limited thereto.

When the controller 190 performs power control to supply the reference power to the pump motor 164, actual operating rpm of the pump motor 164 may be different in the conditions as shown in FIGS. 12 and 13.

For example, when the drainage height corresponds to the first height h1, average rpm of the pump motor 164 during the preset period of time d1 may be about 2,900 rpm, and when the drainage height corresponds to the second height h2, average rpm of the pump motor 164 during the preset period of time d1 may be about 3,100 rpm.

As such, the average rpm of the pump motor 164 during the preset period of time d1 is changed depending on the different condition, and this average rpm may be optimal operating rpm for each condition.

For example, as the drainage height becomes higher, the operating rpm of the pump motor 164 needs to be increased to drain the water in the tub 120 with a larger pressure difference, and as the drainage height becomes lower, the operating rpm of the pump motor 164 needs to be decreased to reduce vibration and noise because the water in the tub 120 may be drained with a smaller pressure difference, According to the disclosure, based on the fact that the average rpm of the pump motor 164 during the preset period of time d1 is changed depending on the different condition when the pump motor 164 is controlled with the reference power, optimal rpm may be calculated simply.

In another example, as shown in FIG. 14, when the drain conduit 161 is blocked by dirt ob, the average rpm of the pump motor 164 during the preset period of time d1 may be increased even when the drainage height is the first height h1.

When the installation condition is not changed, the reference rpm determined in a plurality of draining courses may not be significantly changed. Accordingly, in various embodiments, when a difference in reference rpm between the respective draining courses is equal to or greater than a preset value, the controller 190 may determine that there is a problem in the drain pump 163 and notify this to the user.

The controller 190 may control the inverter circuit 230 or 330 to operate the pump motor 164 at the reference rpm from a time t2 at which the reference rpm is determined to a time t3 at which the water level in the tub 120 reaches the reset water level. Similarly, the controller 190 may control the inverter circuit 230 or 330 to operate the pump motor 164 at the reference rpm even in a reference period of time d2 from the time t3 at which the water level in the tub 120 reaches the reset water level.

At a time t4 after the reference period of time d2 passes from the time t3 at which the water level in the tub 120 reaches the reset water level, the controller 190 may determine that the draining course is completed and control the inverter circuit 230 or 330 to stop operating the pump motor 164.

In various embodiments, the controller 190 may determine the time t3 at which the water level of the tub 120 reaches the reset water level as an ending time of the draining course, and may control the inverter circuit 230 or 330 to operate the pump motor 164 at the reference rpm until the time t4 at which the reference period of time d2 passes from the ending time t3 of the draining course even after completion of the draining course. In this case, even in the early stage of the dehydrating course, the operating rpm of the pump motor 164 may be kept at the reference rpm.

According to the disclosure, noise and vibration caused by the drain pump 163 may be minimized and the efficiency of the drain pump 163 may be maximized by determining the optimal reference rpm in the early stage of the draining course.

Furthermore, according to the disclosure, environmental changes of the washing machine 100 may be dynamically handled by determining the optimal rpm in all draining courses of the laundry cycle.

As the tub 120 is vibrated when the drum 130 is rotated at high speed in a dehydrating course, efficiency of draining is lowered when the pump motor 164 is maintained at a constant operating rpm.

An embodiment for maximizing efficiency of the drain pump 163 and minimizing noise and vibration in the draining course will now be described.

Figure 15:
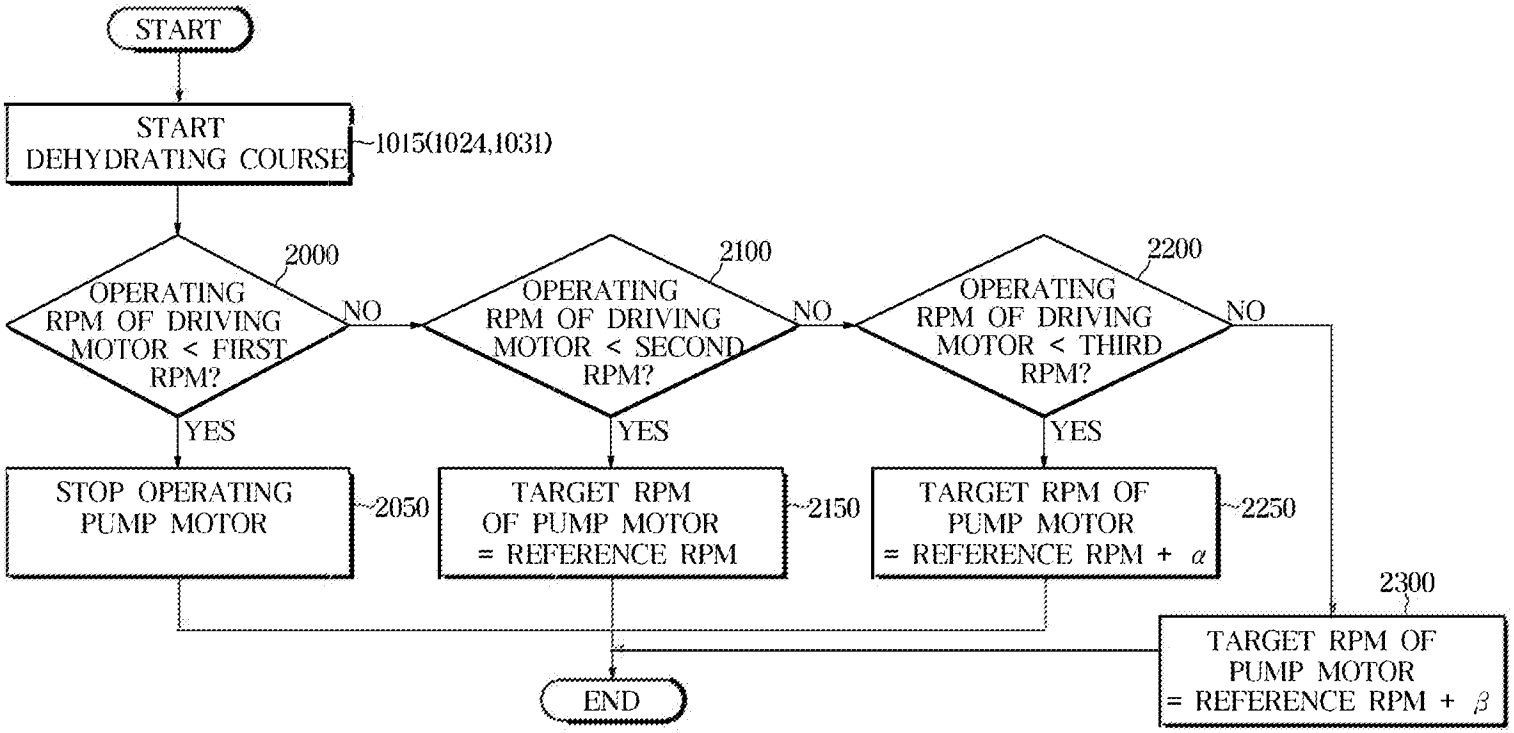
FIG. 15 is a flowchart illustrating an example of a method of controlling a washing machine during a dehydrating course, according to an embodiment.
Figure 16:
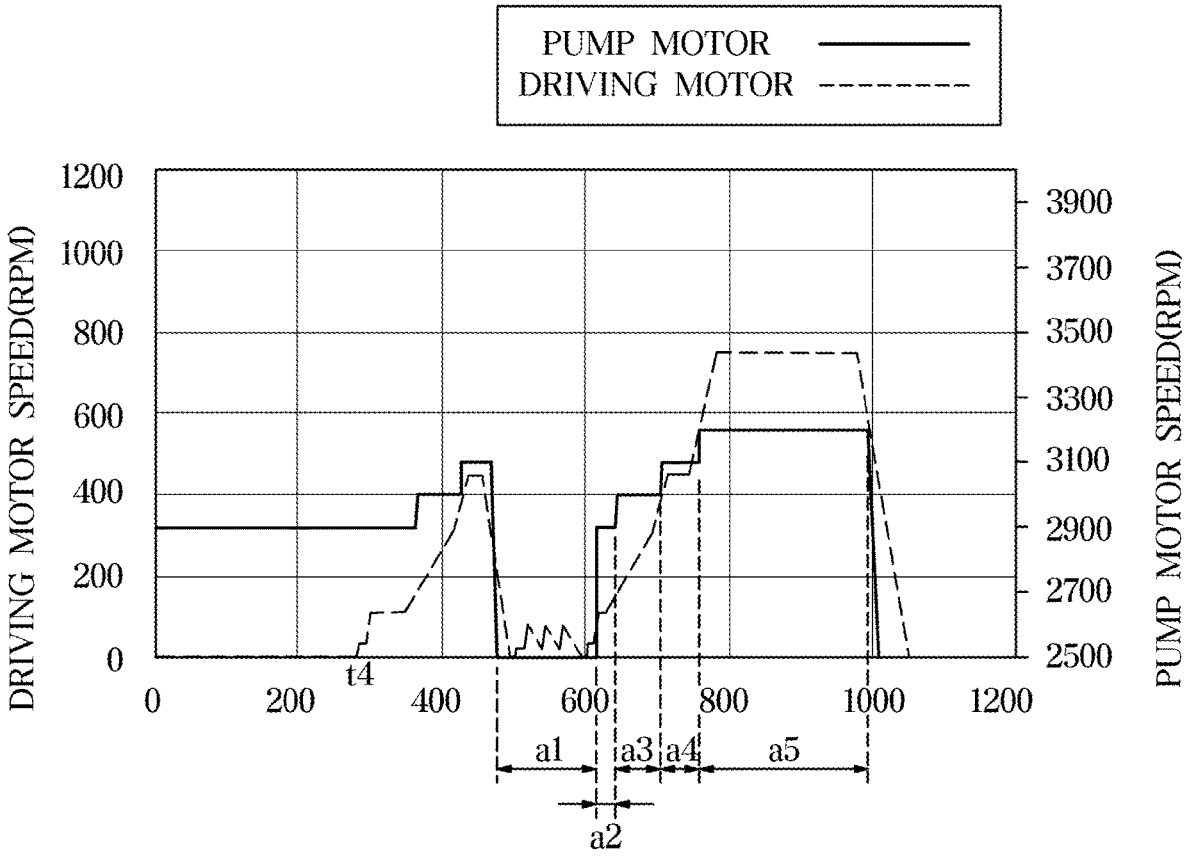
FIG. 16 illustrates operating rpm of a pump motor and a driving motor during a dehydrating course of a washing machine, according to an embodiment.

FIG. 15 is a flowchart illustrating an example of a method of controlling a washing machine during a dehydrating process, according to an embodiment. FIG. 16 illustrates operating rpm of a pump motor and a driving motor during a dehydrating process of a washing machine, according to an embodiment.

In various embodiments, the dehydrating course may include a first dehydrating course to rotate the drum 130 at relatively low speed and a second dehydrating course to rotate the drum 130 at relatively high speed, and may stop rotating the drum 130 in an interval between the first dehydrating course and the second dehydrating course to measure the weight of clothes for washing.

Referring to FIGS. 15 and 16, the controller 190 may control target rpm of the pump motor 164 based on the reference rpm determined in the draining course 1014 or 1023 and the operating rpm of the driving motor 140 when the dehydrating course 1015, 1024 or 1031 begins after completion of the draining course 1014 or 1023.

Specifically, the controller 190 may determine the target rpm of the pump motor 164 to be proportional to the operating rpm of the driving motor 140.

For example, referring to section a1 of FIG. 16, the controller 190 may control the inverter circuit 230 or 330 to stop operating the pump motor 164 in operation 2050, when the operating rpm of the driving motor 140 is lower than first preset rpm in operation 2000.

In this case, the first preset rpm may be set to rpm corresponding to low-speed rotation of the drum 130 and stored in the memory 192. For example, the first preset rpm may be set to about 110 rpm.

In the dehydrating course, water kept in the clothes is separated from the clothes by high-speed rotation of the drum 130. The drain pump 163 may be operated in the dehydrating course not to get rid of the water remaining in the tub 120 but to drain the water separated from the clothes.

Hence, when the pump motor 164 is operated even though the driving motor 140 is being rotated at low speed in the dehydrating course, drain efficiency is lowered and vibration and noise occurs.

According to the disclosure, when it is determined that the drum 130 is rotated at low speed based on the speed of the driving motor 140, the pump motor 164 may be stopped to reduce the vibration and noise.

The time t4 of FIG. 16 refers to a point in time at which a draining course is completed and a dehydrating course begins. Even when the water level in the tub 120 reaches the reset water level, the controller 190 controls the inverter circuit 230 or 330 to operate the pump motor 164 at the reference rpm in the reference period of time d2. Hence, the controller 190 may control the inverter circuit 230 or 330 to operate the pump motor 164 at the reference rpm even when the operating rpm of the driving motor 140 is lower than the first preset rpm in the first dehydrating course.

The purpose of operating the pump motor 164 at the reference rpm even when the operating rpm of the driving motor 140 is lower than the first preset rpm is to get rid of the water remaining in the tub 120 rather than to drain the water separated from the clothes because the first dehydrating course is an early stage of a dehydrating course.

Referring to section a2 of FIG. 16, the controller 190 may control the inverter circuit 230 or 330 to operate the pump motor 164 at the reference rpm in operation 2150, when the operating rpm of the driving motor 140 is higher than the first preset rpm in 2000 and lower than second preset rpm in operation 2100.

In this case, the second preset rpm may be set to rpm at which the drum 130 is rotated at relatively high speed to separate much of water from the clothes, and stored in the memory 192. For example, the second preset rpm may be set to about 130 rpm.

When the operating rpm of the driving motor 140 is equal to or higher than the first preset rpm, vibration may occur in the tub 120, which may prevent the water separated from the clothes from being discharged outside unless the pump motor 164 is operated. Accordingly, drain efficiency is lowered unless the pump motor 164 is operated.

According to the disclosure, when the tub 120 is vibrated to a certain extent and water is separated from the clothes due to the speed of the driving motor 140, the pump motor 164 may be operated at the reference rpm, thereby increasing drain efficiency.

Referring to section a3 of FIG. 16, the controller 190 may control the inverter circuit 230 or 330 to operate the pump motor 164 at first rpm (reference rpm+a) higher than the reference rpm in operation 2250, when the operating rpm of the driving motor 140 is higher than the second preset rpm in operation 2100 and lower than third preset rpm in operation 2200.

In this case, the third preset rpm may be set to rpm at which the drum 130 is rotated at high speed to separate much of water from the clothes, and stored in the memory 192. For example, the third preset rpm may be set to about 300 rpm.

Furthermore, the first rpm may be dynamically determined by adding a first preset value α to the reference rpm, and the first preset value α may be set to as high rpm as to increase efficiency of the drain pump 163 to a small extent and stored in the memory 192. For example, the first preset value α may be set to about 200 rpm.

When the operating rpm of the driving motor 140 is equal to or higher than the second preset rpm, significant vibration may occur in the tub 120, which may prevent the water separated from the clothes from being discharged outside unless the pump motor 164 is operated at higher rpm. Hence, the drain efficiency is lowered when the operating rpm of the pump motor 164 is maintained at the reference rpm.

Furthermore, as noise occurs due to vibration of the tub 120 when the drum 130 is rotated at high speed, noise occurring from the drain pump 163 may be canceled out by the noise from the vibration of the tub 120 even when the operating rpm of the drain pump 163 is increased.

According to the disclosure, when the tub 120 is vibrated due to the speed of the driving motor 140 and the efficiency of the drain pump 163 is lowered, the pump motor 164 may be operated at the first rpm higher than the reference rpm, thereby increasing drain efficiency.

Referring to section a4 of FIG. 16, the controller 190 may control the inverter circuit 230 or 330 to operate the pump motor 164 at second rpm (reference rpm+β) higher than the reference rpm in operation 2300, when the operating rpm of the driving motor 140 is higher than the third preset rpm in operation 2200.

In this case, the second rpm may be dynamically determined by adding a second preset value β to the reference rpm, and the second preset value β may be a value greater than the first preset value α, may be set to as high rpm as to increase efficiency of the drain pump 163 to a small extent and stored in the memory 192. For example, the second preset value β may be set to about 300 rpm.

When the operating rpm of the driving motor 140 is equal to or higher than the third preset rpm, significant vibration may occur in the tub 120, which may prevent the water separated from the clothes from being discharged outside unless the pump motor 164 is operated at higher rpm. Hence, the drain efficiency is lowered when the operating rpm of the pump motor 164 is maintained at the reference rpm.

Furthermore, as noise occurs due to vibration of the tub 120 when the drum 130 is rotated at high speed, noise occurring from the drain pump 163 may be canceled out by the noise from the vibration of the tub 120 even when the operating rpm of the drain pump 163 is increased.

According to the disclosure, when the tub 120 is vibrated due to the speed of the driving motor 140 and the efficiency of the drain pump 163 is lowered, the pump motor 164 may be operated at the second rpm higher than the reference rpm, thereby increasing drain efficiency.

Referring to section a5 of FIG. 16, in various embodiments, the controller 190 may subdivide the operating rpm section of the driving motor 140 to increase the rpm of the pump motor 164.

Specifically, the controller 190 may control the inverter circuit 230 or 330 to rotate the pump motor 164 at higher speed than the second rpm (reference rpm+β) when the operating rpm of the driving motor 140 is higher than fourth preset rpm that is higher than the third preset rpm.

In other words, the disclosure may employ any algorithm to increase the operating rpm of the pump motor 164 with an increase in operating rpm of the driving motor 140 in the dehydrating course.

According to the disclosure, vibration and noise may be minimized and drain efficiency may be maximized by dynamically controlling the operating rpm of the pump motor 164 in the dehydrating course.

Furthermore, according to the disclosure, the drain efficiency may be maximized by increasing the operating rpm of the pump motor 164 when the efficiency of the pump motor 164 is lowered due to vibration occurring at the tub 120 when the drum 130 is rotated at high speed.

Moreover, according to the disclosure, the drain efficiency may be maximized without an increase in noise felt by the user because the operating rpm of the pump motor 164 increases only when the tub 120 is vibrated significantly.

Figure 17:
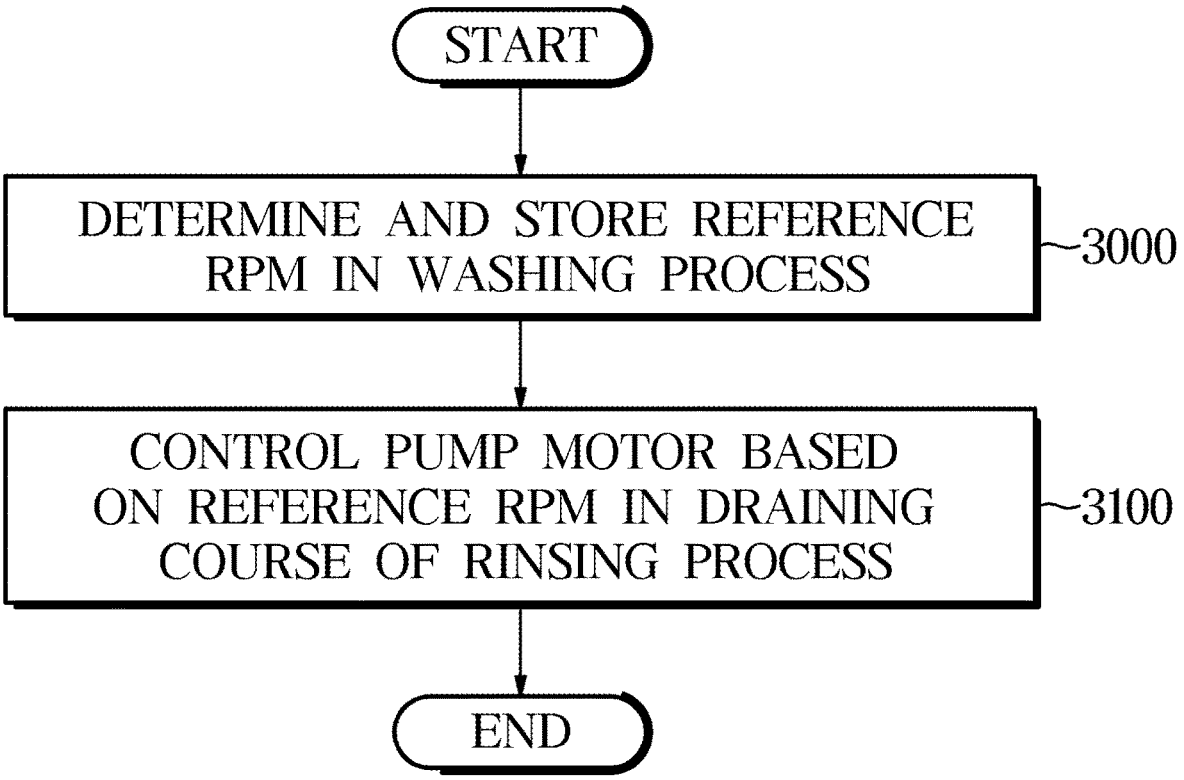
FIG. 17 is a flowchart illustrating an example of a method of controlling a washing machine, according to an embodiment.

FIG. 17 is a flowchart illustrating an example of a method of controlling a washing machine, according to an embodiment.

Referring to FIG. 17, the controller 190 in an embodiment may store reference rpm determined in the draining course 1014 or 1023 in the memory 192 and use the reference rpm.

In an embodiment, the controller 190 may determine the reference rpm in the draining course 1014 of the washing process 1010, in operation 3000, and control pump rpm for the draining course 1023 of the rinsing process 1020 based on the reference rpm determined in the draining course 1014 of the washing process 1010, in operation 3100.

For example, the controller 190 may control the inverter circuit 230 or 330 to operate the pump motor 164 at the reference rpm determined in the draining course 1014 of the washing process 1010 at the start of the draining course 1023 of the rinsing process 1020.

In another embodiment, the controller 190 may determine that there is a problem with the drain pump 163 when a difference between first reference rpm determined in a first draining course (e.g., a draining course in the previous laundry cycle/a draining course in the washing process) and second reference rpm determined in a second draining course (e.g., a draining course in the next laundry cycle/a draining course in the rinsing process) starting after the first draining course, and control the display 112 to output a visual indication to indicate that there is a problem with the drain pump 163.

For example, the controller 190 may control the display 112 to output text that queries as to whether an installation condition of the washing machine 100 has been changed, and control the display 112 to output a visual indication to indicate that there is a problem with the drain pump 163 based on reception of a user input indicating that the installation condition of the washing machine 100 has not been changed.

For example, the controller 190 may control the display 112 to output such a text as "there is a problem with the drain pump" or various visual indications such as icons, figures and/or colors of the drain pump 163.

In another example, the controller 190 may notify the user that there is a problem with the drain pump 163 by controlling the display 112 to output text such as "the installation condition of the washing machine has been changed or problem occurs in the drain pump".

In various embodiments, the controller 100 may use various kinds of components to provide many different feedback indicating that there is a problem with the drain pump 163.

For example, the controller 190 may use a speaker and/or a buzzer to output a sound indicating that there is a problem with the drain pump 163.

According to the disclosure, a change in installation condition of the washing machine 100 or an error of the discharge pump 163 may be detected by storing and comparing reference rpm values determined in the respective draining courses.

Furthermore, according to the disclosure, the pump motor 164 may be operated at optimal rpm in the early stage of the draining course by using the reference rpm determined in each draining course.

Figure 18:
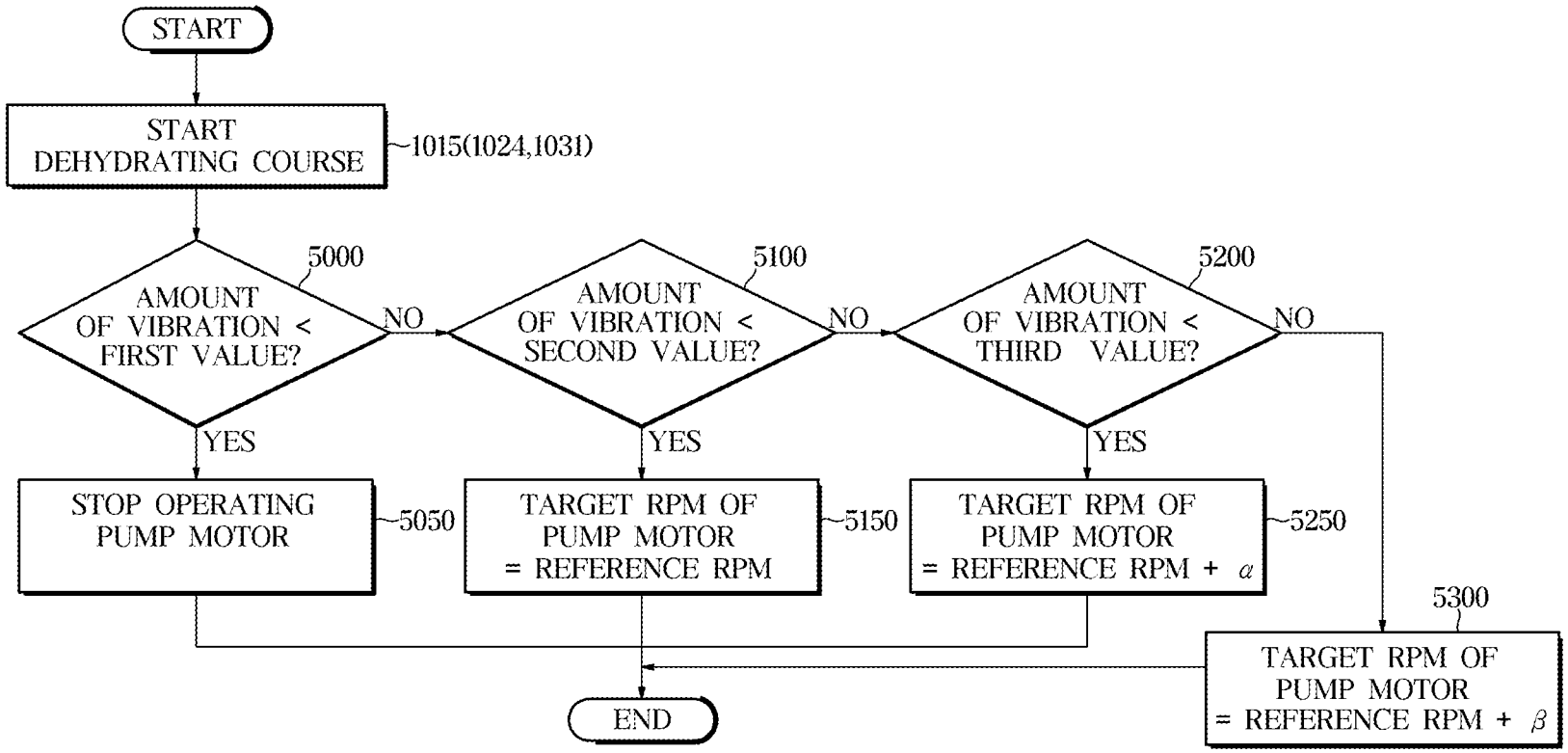
FIG. 18 is a flowchart illustrating another example of a method of controlling a washing machine during a dehydrating course, according to an embodiment.

FIG. 18 is a flowchart illustrating another example of a method of controlling a washing machine during a dehydrating process, according to an embodiment.

Referring to FIG. 18, as described in FIG. 16, the controller 190 may control target rpm of the pump motor 164 based on an amount of vibration of the tub 120 obtained from the vibration sensor 180 and the reference rpm determined in the draining course 1014 or 1023 when the dehydrating course 1015, 1024 or 1031 begins after completion of the dehydrating course 1014 or 1023.

Specifically, the controller 190 may determine the target rpm of the pump motor 164 to be proportional to the amount of vibration of the tub 120.

As the rotation speed of the driving motor 140 and the amount of vibration of the tub 120 are proportional to each other, overlapping description with FIG. 16 will not be repeated.

The controller 190 may control the inverter circuit 230 or 330 to stop operating the pump motor 164 in operation 5050, when the amount of vibration of the tub 120 is smaller than a first preset amount of vibration in operation 5000.

In this case, the first preset amount of vibration may be set to a value corresponding to an amount of vibration occurring at the tub 120 when the driving motor 140 is rotated at the first preset rpm, and stored in the memory 192.

The controller 190 may control the inverter circuit 230 or 330 to operate the pump motor 164 at the reference rpm even when the amount of vibration of the tub 120 is smaller than the first preset amount of vibration in the first dehydrating course.

The controller 190 may control the inverter circuit 230 or 330 to operate the pump motor 164 at the reference rpm in operation 5150, when the amount of vibration of the tub 120 is larger than the first preset amount of vibration in operation 5000 and smaller than a second preset amount of vibration in operation 5100.

In this case, the second preset amount of vibration may be set to a value corresponding to an amount of vibration occurring at the tub 120 when the driving motor 140 is rotated at the second preset rpm, and stored in the memory 192.

The controller 190 may control the inverter circuit 230 or 330 to operate the pump motor 164 at the first rpm (reference rpm+$\alpha$) higher than the reference rpm in operation 5250, when the amount of vibration of the tub 120 is larger than the second preset amount of vibration in operation 5100 and smaller than a third preset amount of vibration in operation 5200.

In this case, the third preset amount of vibration may be set to a value corresponding to an amount of vibration occurring at the tub 120 when the driving motor 140 is rotated at the third preset rpm, and stored in the memory 192.

The controller 190 may control the inverter circuit 230 or 330 to operate the pump motor 164 at the second rpm (reference rpm+$\beta$) higher than the reference rpm in operation 5300, when the amount of vibration of the tub 120 is larger than the third preset amount of vibration in operation 5200.

According to the disclosure, the drain efficiency may be improved by increasing the operating rpm of the pump motor 164 when the efficiency of the drain pump 163 is lowered due to a large amount of vibration of the tub 120. Moreover, according to the disclosure, the drain efficiency may be maximized without an increase in noise felt by the user because the operating rpm of the pump motor 164 increases only when the tub 120 is vibrated significantly.

Meanwhile, the embodiments of the disclosure may be implemented in the form of a recording medium for storing instructions to be carried out by a computer. The instructions may be stored in the form of program codes, and when executed by a processor, may generate program modules to perform operation in the embodiments of the disclosure. The recording media may correspond to computer-readable recording media.

The computer-readable recording medium includes any type of recording medium having data stored thereon that may be thereafter read by a computer. For example, it may be a ROM, a RAM, a magnetic tape, a magnetic disk, a flash memory, an optical data storage device, etc.

The computer-readable storage medium may be provided in the form of a non-transitory storage medium. The term 'non-transitory storage medium' may mean a tangible device without including a signal, e.g., electromagnetic waves, and may not distinguish between storing data in the storage medium semi-permanently and temporarily. For example, the non-transitory storage medium may include a buffer that temporarily stores data.

In an embodiment of the disclosure, the aforementioned method according to the various embodiments of the disclosure may be provided in a computer program product. The computer program product may be a commercial product that may be traded between a seller and a buyer. The computer program product may be distributed in the form of a recording medium (e.g., a compact disc read only memory (CD-ROM)), through an application store (e.g., Play Store™), directly between two user devices (e.g., smart phones), or online (e.g., downloaded or uploaded). In the case of online distribution, at least part of the computer program product (e.g., a downloadable app) may be at least temporarily stored or arbitrarily created in a recording medium that may be readable to a device such as a server of the manufacturer, a server of the application store, or a relay server.

The embodiments of the disclosure have thus far been described with reference to accompanying drawings. It will be obvious to those of ordinary skill in the art that the disclosure may be practiced in other forms than the embodiments as described above without changing the technical idea or essential features of the disclosure. The above embodiments are only by way of example, and should not be construed in a limited sense.

What is claimed is:

1. A washing machine comprising:

a washing tub;

a drain pump configured to drain water in the washing tub;

a pump motor configured to operate the drain pump;

an inverter circuit configured to supply a driving current to the pump motor to operate the drain pump; and a controller configured to:

control the inverter circuit to supply pre-set reference power to the pump motor based on a start of a draining course;

determine reference revolutions per minute (rpm) based on an average value of an operating rpm of the pump motor during a preset period of time in which the pre-set reference power is supplied to the pump motor; and in response to the determining of the reference rpm, control the inverter circuit to operate the pump motor at the determined reference rpm.

2. The washing machine of claim 1, the preset period of time begins after a reference time has elapsed after the draining course is started.

3. The washing machine of claim 1, further comprising: a display, wherein the draining course comprises a first draining course and a second draining course which starts after the first draining course, wherein the reference rpm includes a first reference rpm determined in the first draining course and a second reference rpm determined in the second draining course; and wherein the controller is configured to control the display to output a visual indication to indicate that the drain pump has a problem based on a difference between the first reference rpm and the second reference rpm being equal to or greater than a preset value.

4. The washing machine of claim 1, further comprising:

a water level sensor configured to detect a water level of the water in the washing tub, wherein the controller is further configured to control the inverter circuit to operate the pump motor at the reference rpm from a time at which the reference rpm is determined to a time at which a reference time passes after the water level in the washing tub reaches a preset water level.

5. The washing machine of claim 4, wherein the preset water level is a reset water level, which a threshold water level where the controller determines that the draining course is completed.

6. The washing machine of claim 1, further comprising a driving motor configured to rotate a drum within the washing tub, wherein the controller is further configured to control a target rpm of the pump motor based on the reference rpm and an operating rpm of the driving motor at a start of a dehydrating course after the draining course is completed.

7. The washing machine of claim 6, wherein the controller is further configured to control the inverter circuit to stop driving the pump motor based on determining that the operating rpm of the driving motor is lower than a first preset rpm.

8. The washing machine of claim 7, wherein the controller is further configured to control the inverter circuit to operate the pump motor at the reference rpm based on determining that the operating rpm of the driving motor is higher than the first preset rpm and is lower than a second preset rpm.

9. The washing machine of claim 8, wherein the controller is further configured to control the inverter circuit to operate the pump motor at a first rpm which is higher than the reference rpm based on the determining that the operating rpm of the driving motor is higher than the second preset rpm and is lower than a third preset rpm.

10. The washing machine of claim 9, wherein the controller is further configured to control the inverter circuit to operate the pump motor at a second rpm which is higher than the first rpm based on the determining that the operating rpm of the driving motor is higher than the third preset rpm.

11. A method of controlling a washing machine comprising a washing tub, a drain pump configured to drain water in the washing tub, a pump motor configured to operate the drain pump, an inverter circuit configured to supply a driving current to the pump motor to operate the drain pump, and a controller, the method comprising:

controlling an inverter circuit to supply a pre-set reference power to a pump motor which operates a drain pump based on a start of a draining course;

determining reference revolutions per minute (rpm) based on an average value of an operating rpm of the pump motor during a preset period of time which the pre-set reference power is supplied; and in response to the determining of the reference rpm, controlling the inverter circuit to operate the pump motor at the determined reference rpm.

12. The method of claim 11, wherein the preset period of time begins after a reference time has elapsed after the draining course is started.

13. The method of claim 11, wherein the reference rpm includes a first reference rpm determined in a first draining course and a second reference rpm determined in a second draining course which starts after the first draining course, and wherein the reference rpm includes a first reference rpm determined in the first draining course and a second reference rpm determined in the second draining course and wherein the method further comprising:

outputting a visual indication indicating that the drain pump has a problem based on a difference between the first reference rpm and the second reference rpm being equal to or greater than a preset value.

14. The method of claim 11, further comprising:

detecting a water level in a washing tub, wherein the controlling of the inverter circuit to operate the pump motor at the reference rpm comprises controlling the inverter circuit to operate the pump motor at the reference rpm from a time at which the reference rpm is determined to a time at which a reference time passes after a water level in the washing tub reaches a preset water level.

15. The method of claim 14, wherein the preset water level is a reset water level which a threshold water level where the controller determines that the draining course is completed.

16. The method of claim 11, further comprising: controlling a target rpm of the pump motor based on the reference rpm and an operating rpm of a driving motor which rotates a drum at a start of a dehydrating course after the draining course is completed.

17. The method of claim 16, wherein the controlling of the target rpm of the pump motor comprising controlling the inverter circuit to stop driving the pump motor based on the operating rpm of the driving motor being lower than a first preset rpm.

18. The method of claim 17, wherein the controlling of the target rpm of the pump motor comprising controlling the inverter circuit to operate the pump motor at the reference rpm based on the operating rpm of the driving motor being higher than the first preset rpm and being lower than a second preset rpm.

19. The method of claim 18, wherein the controlling of the target rpm of the pump motor comprising controlling the inverter circuit to operate the pump motor at a first rpm which is higher than the reference rpm based on the operating rpm of the driving motor being higher than the second preset rpm and being lower than a third preset rpm.

20. The method of claim 19, wherein the controlling of the target rpm of the pump motor comprising controlling the inverter circuit to operate the pump motor at a second rpm which is higher than the first rpm based on the operating rpm of the driving motor being higher than the third preset rpm.

* * * * *